US006305051B1

(12) United States Patent
Cho

(10) Patent No.: US 6,305,051 B1
(45) Date of Patent: Oct. 23, 2001

(54) FINGER SUPPORTING STRUCTURE

(76) Inventor: Myong Ho Cho, 205-153, Cheongryang 2-dong, Dongdaemoon-ku, Seoul 130-012 (KR)

( * ) Notice: Subject to any disclaimer, the term of this patent is extended or adjusted under 35 U.S.C. 154(b) by 0 days.

(21) Appl. No.: 09/423,023

(22) PCT Filed: Apr. 28, 1998

(86) PCT No.: PCT/KR98/00106

§ 371 Date: Mar. 17, 2000

§ 102(e) Date: Mar. 17, 2000

(87) PCT Pub. No.: WO98/48979

PCT Pub. Date: Nov. 5, 1998

(30) Foreign Application Priority Data

Apr. 28, 1997 (KR) ..... 97/17165

(51) Int. Cl.[7] ..... B25G 3/00; B25G 1/10

(52) U.S. Cl. ..... 16/430; 16/436; 16/DIG. 12; 81/177.1; 81/489; 473/549; 473/568

(58) Field of Search ..... 16/430, 436, 422, 16/DIG. 12, DIG. 19; D8/80, 107, 312, 313, 303; D7/393, 395; D22/117, 118; 81/177.1, 177.3, 489; 74/551.8, 551.9; 473/538, 549, 568; 482/49, 50, 82, 106, 126; 43/18.1, 23

(56) References Cited

U.S. PATENT DOCUMENTS

| | | | | |
|---|---|---|---|---|
| 2,091,458 | * | 8/1937 | Sleight | 16/DIG. 12 |
| 2,124,615 | * | 7/1938 | Foltz | 16/DIG. 12 |
| 2,252,054 | * | 8/1941 | Welch | 16/DIG. 12 |
| 3,084,938 | * | 4/1963 | Kapanowski | 16/DIG. 12 |
| 3,817,521 | * | 6/1974 | Wright | 473/551 |
| 3,868,110 | | 2/1975 | Jones . | |
| 3,905,598 | | 9/1975 | Ballog . | |
| 4,140,123 | * | 2/1979 | Curutchet | 81/177.3 |
| 4,283,854 | * | 8/1981 | Austin | 16/DIG. 12 |
| 4,588,469 | | 5/1986 | Hunter . | |
| 4,599,920 | * | 7/1986 | Schmid | 81/489 |
| 4,749,183 | | 6/1988 | Cho . | |
| 4,750,760 | | 6/1988 | Gurley . | |
| 4,885,818 | | 12/1989 | Arterbury . | |
| 5,366,218 | | 11/1994 | Gong . | |

FOREIGN PATENT DOCUMENTS

| | | |
|---|---|---|
| 178500 | 3/1906 | (DE) . |
| 3540565 | 6/1987 | (DE) . |
| 333822 | 7/1903 | (FR) . |

* cited by examiner

*Primary Examiner*—Chuck Y. Mah
(74) *Attorney, Agent, or Firm*—Wolf, Greenfield & Sacks, P.C.

(57) ABSTRACT

A finger supporting structure (F) includes a grip portion and a finger supporter (T) formed thereto. The grip portion is of an elongated bar shape and has adequate length and thickness for a hand to grasp. The grip portion is either all or part of a grasping member of an implement or all or part of a gripping member (G) having internal hole to receive the grasping member of an implement. The finger supporter (T) is a laterally extending projection rigidly formed, in one piece, on the grip portion. The finger supporter (T) is angled to be inclined with respect to the axis (X) of the grip portion in order that the resultant force of the muscles of the digits and hand can be generated and exerted to the optimal. The finger supporting structure (F) is embodied in the grasping members of various implements and thereby provides gripping parts (H) having finger supporter (T) of the implements.

52 Claims, 8 Drawing Sheets

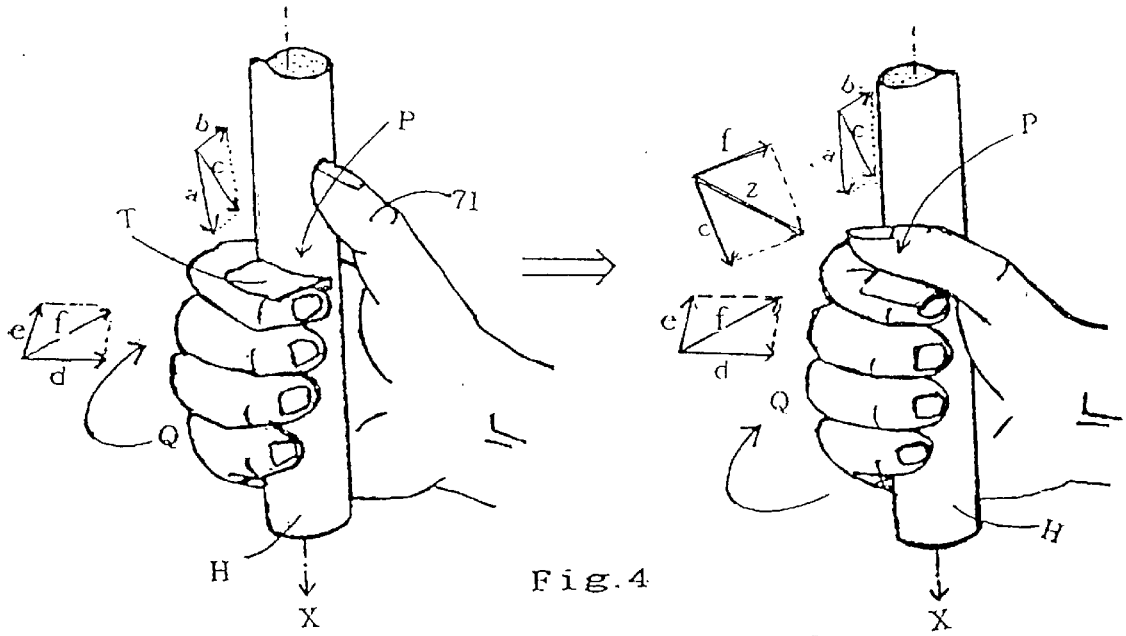
Fig.4
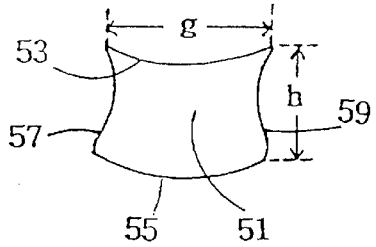
Fig.5
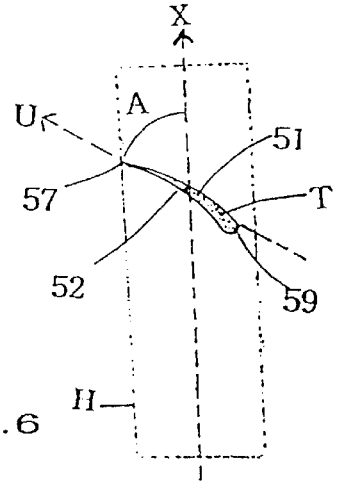
Fig.6
Fig.7
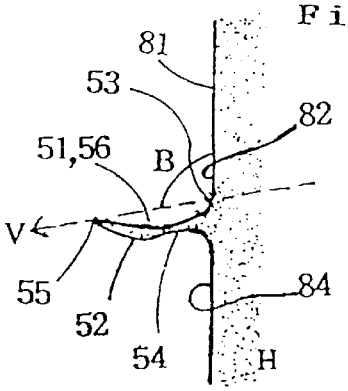
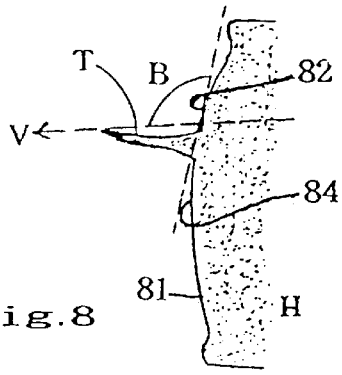
Fig.8

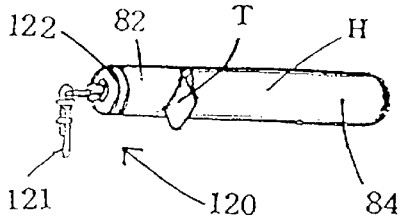
Fig.14
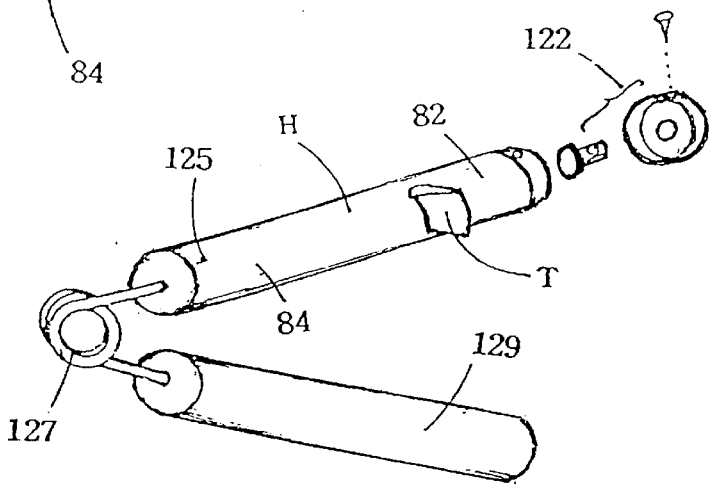
Fig.15
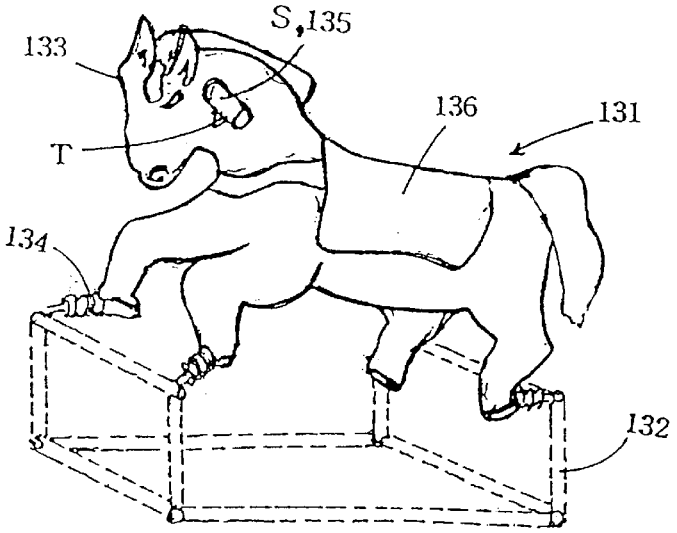
Fig.16
Fig.17
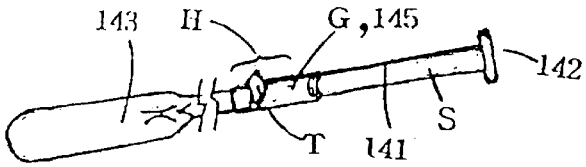
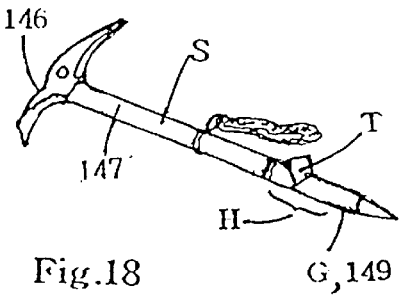
Fig.18

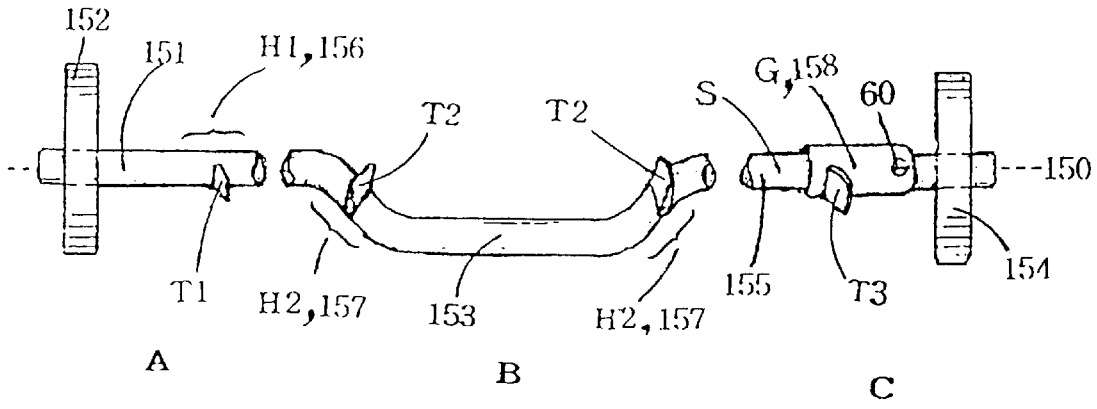
Fig.19
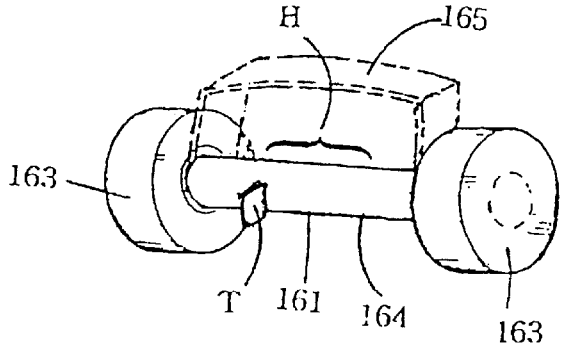
Fig.20
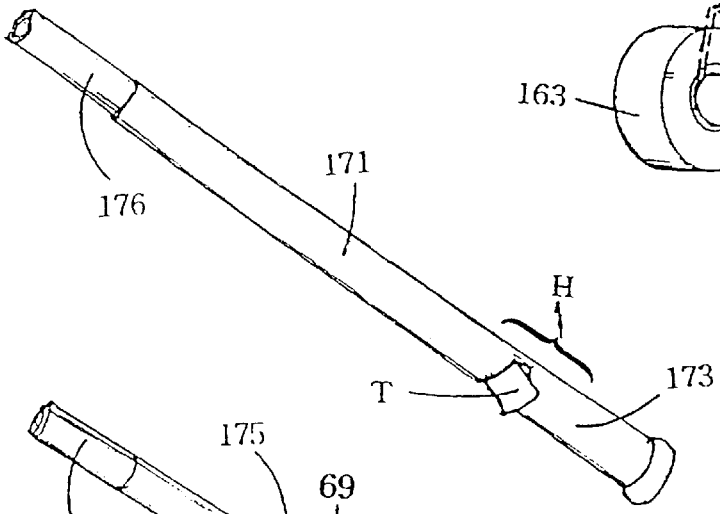
Fig.21
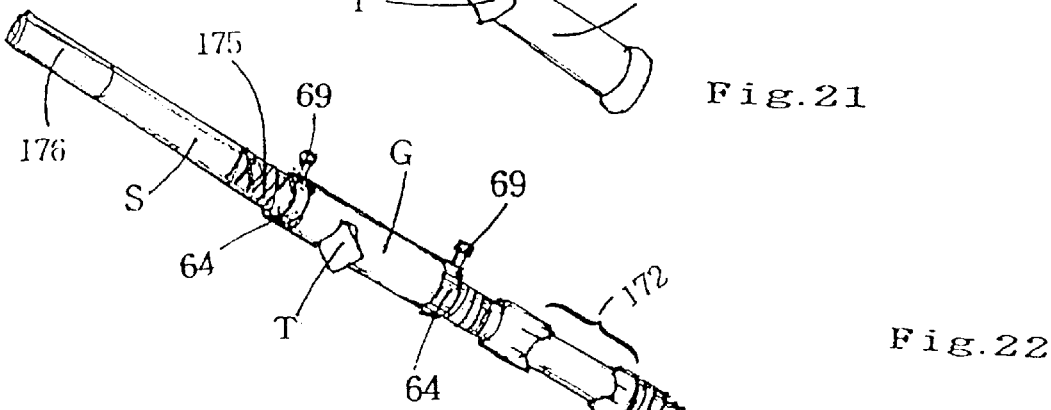
Fig.22
Fig.23
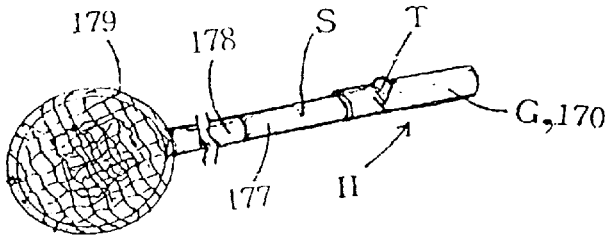

Fig.29
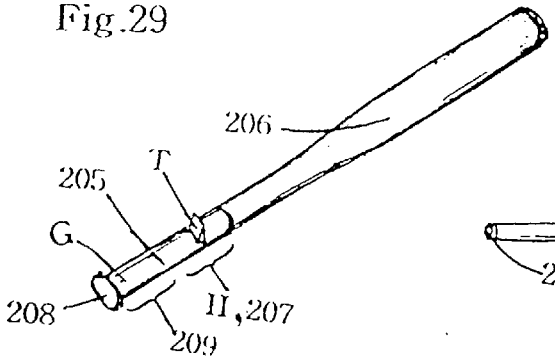
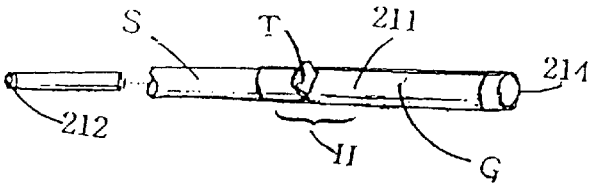
Fig.30
Fig.31
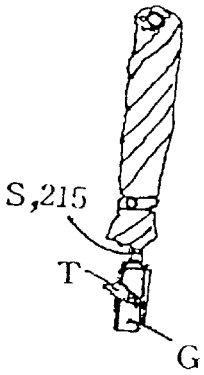
Fig.32
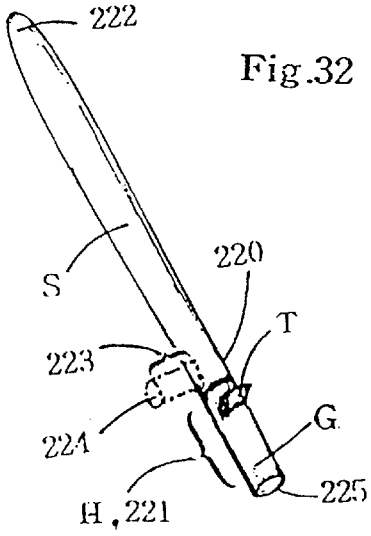
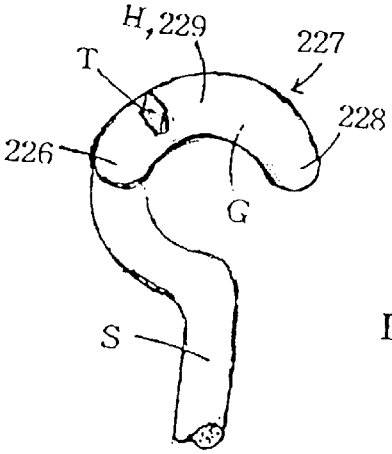
Fig.33

Fig.34
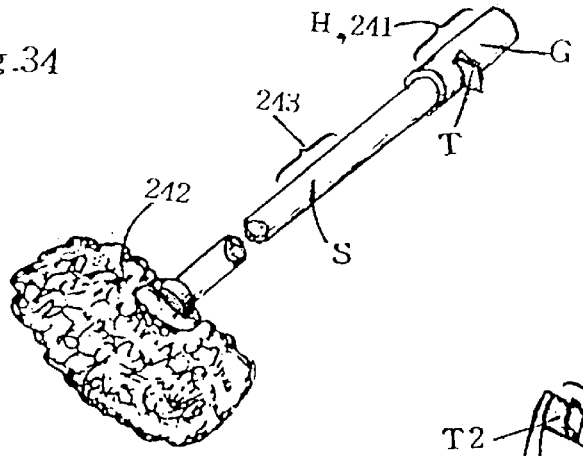
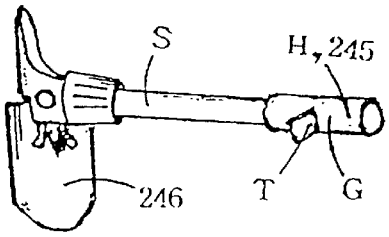
Fig.35
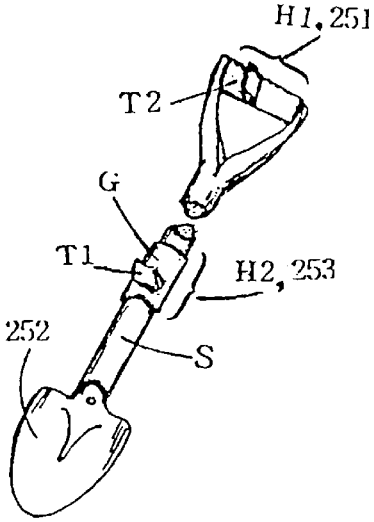
Fig.36
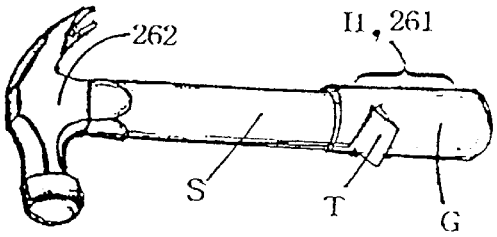
Fig.37
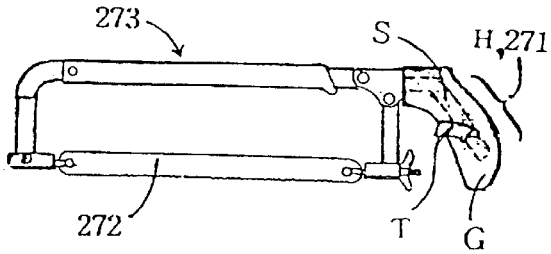
Fig.38

FINGER SUPPORTING STRUCTURE

The present invention relates to a finger supporting structure comprised of an elongated bar-shaped grip portion having adequate length and thickness for a hand to grasp and a finger supporting means rigidly formed on said grip portion in one piece.

Since the invention of tools, there have been numerous implements, equipments, instruments, devices, tackles, appliances, facilities, articles, and so on, each of which has a bar-shaped handle or gripping part which are intended to be grasped and moved by the hand so as to effect some results.

For convenience, throughout the specification, the term "implement" is used to representatively designate these tools, and so on, each of which has a bar-shaped gripping part for the users to grasp.

The description and drawings related to the grip portion 49 or gripping member G having finger supporter T of the present invention are intended mostly for the right hand, it being understood that that for the left hand can be made as a mirror-image version of that for the right hand.

TECHNICAL FIELD AND BACKGROUND OF INVENTION

In grasping an object, it is desirable for a hand to grasp the object with maximum amount of power, stability and precision over the movement of the object. This should be done while minimizing the fatigue in the digits, hand and arm resulting from such movements.

However, conventional grips or handles of implements are designed to have a mere bar-shape according to tradition rather than according to anatomical and physiological consideration. Thus, in grasping the gripping part or area of these implements, it has been impossible for the users to impartially, stably, and optimally use all the muscles of five digits, especially those of the thumb, index finger, and/or middle finger. In the description, the term "four fingers" denotes the second, third, fourth and fifth digit excluding the thumb.

In grasping an object, when all the flexors and adductors of the fingers hand, and arm are fully and stably activated in the similar manner as that for making a fist, the hand can grasp it with full power, firmness, accuracy and stability, and potential force can also be generated to the optimal.

When one makes a fist, the four fingers adduct to each other and flex into the palm, and the thumb also adducts, flexes, and wraps around the outside of the index and/or middle finger, and at this moment, all the flexors and adductors (see FIG. 2) of the fingers and hand are exerted to the optimal.

The mechanisms of movements of the flexors and adductors of the digits, hand, and arm are as follows.

In FIG. 4, the vector "a" denotes the force of the flexors of the thumb drawing the thumb to the palm and the vector "b" denotes the force of the adductors of the thumb drawing the thumb to the index finger. The letter "c" denotes the resultant force of vectors "a" and "b", and denotes the drawing force of the thumb to grasp the gripping part H.

Accordingly, in order to firmly grasp the gripping part H, the resultant force "c" of the thumb must be fully generated and exerted.

In FIG. 4, the vector "d" denotes the force of the flexors of the four fingers drawing the four fingers to the palm and the vector "e" denotes the force of adductors of the four fingers and the thumb exerting to one another. The letter "f" is the resultant force of vectors "d" and "e", and denotes the drawing force of the four fingers to grasp the gripping part H.

In order to firmly grasp the gripping part H, the resultant force "f" of the four fingers also must be fully generated and exerted.

Further, in order for a hand to grasp the gripping part H with full power and firmness, the resultant force "c" of the thumb and that "f" of the four fingers should be concentrated to a point or place as possible as can be.

Again in the right figure in FIG. 4, the letter "z" denotes the resultant force of vectors "c" and "f", and denotes the grasping force of the whole muscles in the digits, hand and arm to grasp the gripping part H.

In order to strongly, firmly, stably, and accurately grasp the gripping part H, said resultant force "z" must be fully generated and exerted.

In short, the resultant force of the thumb(vector "c") and the resultant force of the four fingers(vector "f") are so exerted as to be concentrated to and, encounter with each other at a point or place for the resultant force "z" to be fully generated and exerted.

FIG. 1 shows a right hand grasping the gripping part of a conventional bar-shaped handle of a certain implement.

When the four fingers wind around and grasp the gripping part H in the direction of arrow Q, the grasping force of the flexors of the four fingers is supported by the gripping part H but nothing except the thumb buttresses the grasping force of the adductors of the four fingers. Accordingly, the whole drawing force of the four fingers can not be fully generated and exerted.

In case of the thumb, it is bent in the direction of arrow P that is almost perpendicular to the direction Q of the locomotion of the four fingers. At this moment, the grasping force of the adductors of the thumb is supported by the gripping part H but nothing except the four fingers buttresses the grasping force of the flexors of the thumb, such that the whole drawing force of the thumb can not be fully generated and exerted.

Consequently, in order to more firmly grasp the gripping part H, the thumb is stick fast to, presses, or pushes the four fingers.

The very pressure or pushing of the thumb weakens the grasping force of the four fingers, let the four fingers loose stability and firmness, and, in turn, the unstable grasping force of the four fingers let the thumb more forcefully push the four fingers, which consequently makes the grasping power of the whole hand be weakened and unstable.

Further, as the digits and hand are normally more likely to slip with perspiration, the unstableness and slippage will grow much more when perspired.

In short, the structures of the conventional bar-shaped gripping parts have not been sufficient for the muscles in the digits and hand to be ultimately and harmoniously exerted, such that it has been difficult for the digits and hand to grasp the gripping part with full power, firmness, accuracy, and stability.

In order to overcome the deficiencies and shortcomings of the conventional bar-shaped gripping part of the handle of an implement, the present invention provides a finger supporting means T to the gripping part as shown in FIG. 3.

As shown in FIG. 4 that illustrates the procedure for a hand to grasp the gripping part H of an implement in FIG. 3.

as the drawing force of the flexors of the thumb (vector "a") is supported by the finger supporter T and the drawing force of the adductors of the thumb (vector "b") is supported by the gripping part H, the power of resultant force "c" of the thumb can be exerted to the optimal, and likewise, as the drawing force of the flexors of the four fingers (vector "d") is supported by the gripping part H and the drawing force of the adductors of the four finger and those between the index finger and the thumb (vector "e") is supported by the finger supporter T, the power of resultant force "f" of the four fingers can be exerted to the optimal.

Accordingly, as the resultant force of the thumb(vector "c") and the resultant force of the four fingers(vector "f") are so exerted as to be concentrated to and encounter with each other at the finger supporter T, the resultant force "z" of the whole muscles of the digits and hand can be fully generated and exerted, such that one can grasp and control the gripping part H of the present invention with full strength, firmness, stability, and accuracy.

DESCRIPTION OF PRIOR ART

In the prior art, there have been special grips or handles that have grooves, depressions, ridges or flanges to receive the digits of the hand.

However these features are contoured only for the digits to rest thereon adequately. Thus, these features can not perform any role in generating the above-described resultant force of the digits.

OBJECTS OF THE INVENTION

Thus, it is an object of the present invention to provide a finger supporting structure having finger supporting means to the bar-shaped handle of an implement, which can maximize the resultant force of the flexors and adductors of the digits grasping the handle, and thereby to enhance the power, stability, firmness, accuracy, and efficiency of gripping action of the whole digits and hand using the implement.

BRIEF DESCRIPTION OF THE DRAWINGS

The numerals used in the specification and drawings designate the same or similar elements throughout the description and various figures.

FIG. 4 illustrates the procedure to grasp the gripping part H having finger supporter T of the present invention.

FIG. 5 shows only the finger supporter T part in FIG. 3

FIG. 6 is a cross sectional view of the line L—L in FIG. 3.

FIG. 7 is a cross sectional view of the line M—M in FIG. 3,

FIG. 8 illustrates, in section, a further embodiment of the grip part H.

FIG. 14 is a perspective view of a handle of a skipping rope.

FIG. 15 is a perspective view of an exercising apparatus having handle of a skipping rope structure and handgrip exercising structure.

FIGS. 16, 17, and 18 are perspective views of a rocking type ride-on toy, an oar and an ice ax, respectively.

FIG. 19 illustrates three parts of barbells, in part.

FIG. 20 is a perspective view of a dumbbell.

FIGS. 21 and 22 are perspective, partly broken, views of fishing rods.

FIG. 23 is a perspective view of a fish landing net.

FIGS. 29 through 38 illustrate, some in part, a baseball bat, billiard cue, an umbrella, a police baton, a stick, a mop, a folding shovel, a shovel, a hammer, and a hacksaw respectively.

BEST MODES FOR CARRYING OUT THE INVENTION

The finger supporting structure F of the present invention is comprised of an elongated bar-shaped grip portion having adequate length and thickness for a hand to grasp and a finger supporting means integrally formed thereto.

For convenience, the term "finger supporter" is used to designate said finger supporting means.

Figure 1:
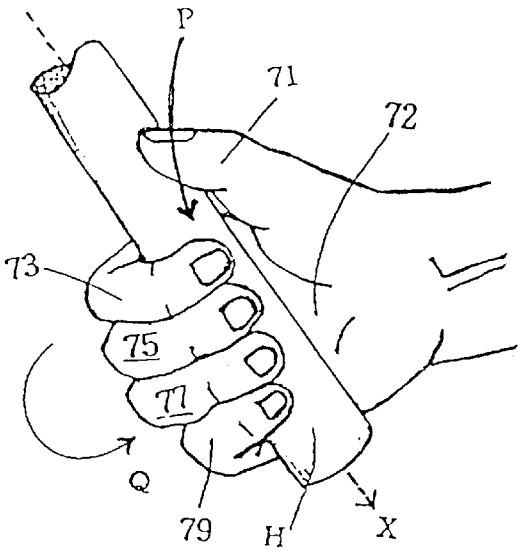
FIG. 1 shows the gripping part of a conventional bar-shaped handle of a certain implement and a hand grasping it.
Figure 2:
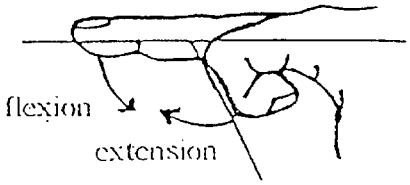
FIG. 2 shows the directions of movements of the digits.
Figure 2:
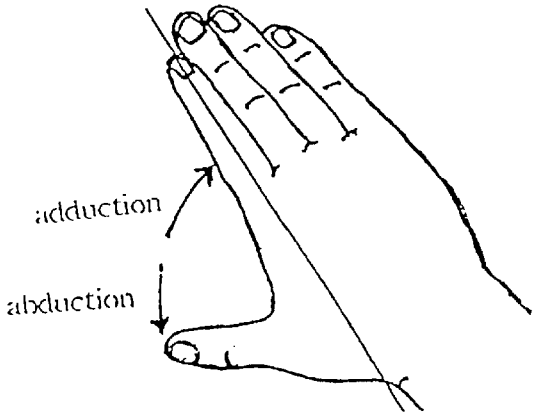
Figure 3:
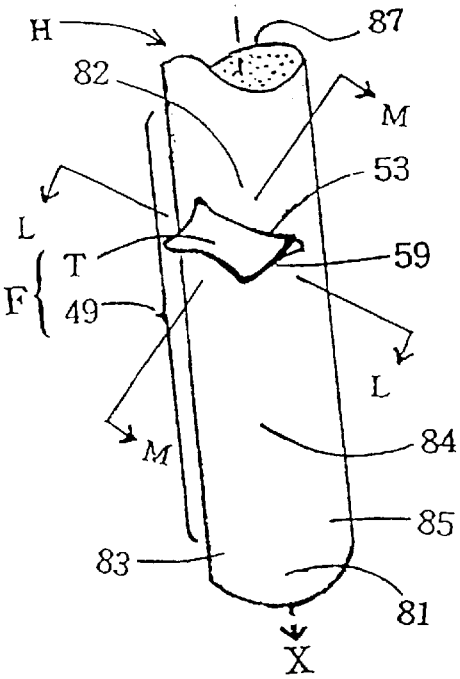
FIG. 3 is a perspective view of the gripping part H.

In FIG. 3, a finger supporting structure F comprised of a grip portion 49 and a finger supporter T integrally formed thereon as a unified body is embodied in the gripping part H of an implement.

FIG. 4 illustrates the procedure that a hand grasps the gripping part H of an implement in FIG. 3.

As shown in FIG. 4, first, as the drawing force of the flexors of the thumb (vector "a") is supported by the finger supporter T and the drawing force of the adductors of the thumb (vector "b") is supported by the grip portion 49, maximum resultant force "c" of the thumb can be exerted to the optimal, and second, as the drawing force of the flexors of the four fingers (vector "d") is supported by the grip portion 49 and the drawing force of the adductors of the four finger and those between the index finger and the thumb (vector "e") is supported by the finger supporter T, the power of resultant force "f" of the four fingers can be exerted to the optimal.

Accordingly, as the resultant force of the thumb(vector "c") and the resultant force of the four fingers(vector "f") are so exerted as to be concentrated to and encounter with each other at the finger supporter T, the resultant force "z" of the muscles of the whole digits, hand and arm can be fully generated and exerted, such that one can grasp the gripping part H of an implement with full strength, firmness, stability, and accuracy.

Generally, the terminologies "handle, grip, grip area, grip part, and so on" are used to designate certain parts of implements that the user's hand grasps to use said implements. Each of these "handle grip, grip area and grip part" of implements has an elongated bar-shaped physical grasping member for the user's hand to grasp.

A user normally grasps "all or some part of the grasping member" when he uses the implement. For convenience, the term "gripping part" is used to denote said "all or some part of the grasping member having adequate length for a hand to grasp".

There are two types of gripping parts. First, the gripping part H comprises all or some portion of said grasping member itself such as the handle 120 of a skipping rope in FIG. 14 or the grip area 156 of the bar 151 of a barbell in FIG. 19, and second, the gripping part H is comprised of said all or some portion of the grasping member(shaft S) and a hollow gripping member G secured thereto such as the handle of a ski pole in FIG. 9.

Each of these two types of "gripping part H" has a "portion" which has adequate length and thickness for the four fingers to wrap in one direction and the thumb in the opposite direction to grasp the gripping part H and use the implement.

The term "grip portion" is used to denote said "portion of the gripping part H" which has adequate length and thickness for a hand to exactly grasp.

Figure 11:
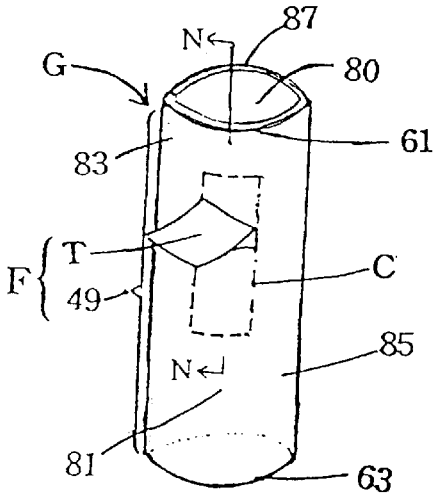
FIG. 11 is a perspective view of a gripping member G of the present invention that is separately formed and has tubular interior hole.

In FIGS. 3, the "grip portion 49" is provided to the grasping member (shaft S) and forms the gripping part H, and in FIG. 11, the "grip portion 49" is provided to the gripping member G.

As described, the finger supporting structure F of the present invention is comprised of a bar-shaped grip portion and a finger supporter T integrally formed thereon as a unified body.

Accordingly, the finger supporting structure F can be embodied in these two members. First, the finger supporting structure F can be embodied in the grip portion 49 comprised of all or some portion of the grasping member itself, and second it can be embodied in the grip portion 49 of the gripping member G that is separately formed and secured to the grasping member.

The grip portion 49 is substantially circular or rectangular character in section and has adequate length and thickness to be gripped by a hand.

In this specification, for clarity, the surface of the grip portion 49 is described generally to be divided into four sides as shown in FIG. 3, that is, the fore side 83 for receiving the middle phalanx part and/or proximal interphalangeal joint part of the four fingers, the rear side 85 for receiving the heel part of the palm, the outer side 87 for receiving the middle part or hollow of the palm, and the inner side 81 for receiving the tip part(distal, middle and/or proximal phalanx part) of the four fingers and the thumb.

The surface of four sides 81, 83, 85 and 87 of the grip portion 49 has substantially the same surface level along the length, as shown in FIG. 7, but the grip portion 49 may optionally be formed to have medial portion circumferentially raised along its periphery, as shown in FIG. 8.

Figure 9:
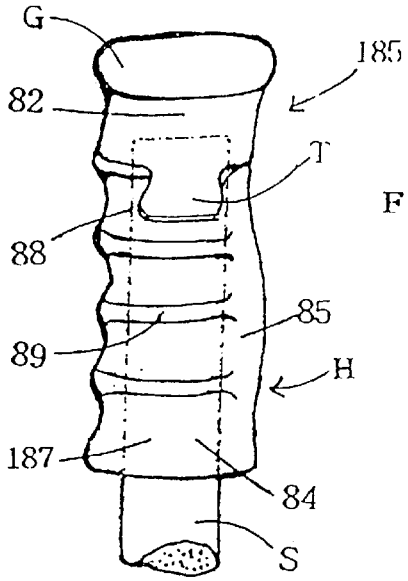
FIGS. 9 And 10 illustrate the gripping member G secured to a grasping member and thereby form the gripping part H of an implement, respectively.

Further, ridges 89, associated grooves 88, or elevated portion known in the art may optionally be provided to the fore side 83, inner side 81, and the rear side 85 of the grip portion 49, respectively, as shown in FIG. 9.

In FIG. 3, the numeral 82 denotes "thumb touching part" of the inner side 81 on which thumb touches and the numeral 84 denotes "finger touching part" of the inner side 81 on which the four fingers excluding the thumb wrap around.

Of the parts 82 and 84 of the inner side 81, the surfaces of the parts on which the thumb and the index finger touch are formed to have substantially the same surface level along the length, as shown in FIG. 7, in order to provide equal disposition and arrangement for the thumb and the index finger to generate maximum resultant forces "c", "f" and "z".

In FIG. 8, the gripping part H, in section, has medial portion circumferentially raised along its periphery, such that the inner side 81 also has slightly raised surface.

In this case, however, as the surfaces of the parts on which the thumb and the index(and/or middle) finger touch are next to each other, they are also substantially on the same surface level.

Further, when the grip portion 49 is formed to have grooves 88 to receive the fingers, as shown in FIG. 9, the overall surface level of the grooves 88, especially those on which the thumb and index(or middle) finger are positioned is formed to have substantially the same surface level along the length of the grip portion 49.

The grip portion illustrated and explained in the specification is straight bar character in length but it may be curved bar.

The finger supporter T is a laterally extending projection formed on the grip portion 49 in one piece and has sides to receive the thumb and index(or middle) finger. As an example, the finger supporter T in FIG. 3 is a laterally extending, thin, plate-shaped projection formed on the grip portion 49 as a unified body.

The finger supporter T is fixedly and rigidly formed on the grip portion 49 as a unified body in order to let the drawing forces(vectors "c" and "f") of the thumb and the four fingers, respectively, be buttressed thereby.

The finger supporter T is formed on the inner side 81 of the grip portion 49, on which the user normally places the distal phalanx parts of the thumb and other fingers as shown in FIG. 3.

The finger supporter T is formed to be positioned at the place of the grip portion 49 on which the thumb touches the index finger in order that the finger supporter T may be placed between the thumb and index finger when the user grasps the gripping part H of an implement in a normal fashion.

FIG. 5 shows only the finger supporter T part in FIG. 3 with the surface 51 to be touched by the thumb being on the plane. In FIG. 5, the overall shape of the upper side 51 of the finger supporter T is, in plane, almost tetragonal.

The numerals 57 and 59 denote the fore and rear end(or edge) part of the finger supporter T on which the tip part(distal phalanx part) of the thumb and the inner part thereof is touched, respectively. The numerals 53 and 55 denote the inner and outer end part of the finger supporter T, respectively. The inner end part 53 is integrally connected to the surface of the grip portion 49 as a unified body.

In FIG. 5, the letter "g" denotes the length of the finger supporter T, that is, the straight distance between the fore end part 57 and the rear end part 59 of the finger supporter T, and the letter "h" denotes the width of the finger supporter T, that is, the straight distance between the outer end part 55 and the inner end part 53 of the finger supporter T.

The length "g" can range from 10 mm to 60 mm, and the width "h" can range from 10 mm to 40 mm. However, these do not limit the ranges of the length "g" and width "h" of the finger supporter T. When above said grooves 88 are formed in the grip portion 49, the width "h" of the finger supporter T denotes the perpendicular distance between the outer end part 55 and the deepest bottom of the groove 88 which is provided at the thumb touching part 82.

The thickness of the finger supporter T is moderate enough to be comfortably placed between the thumb and index finger and at the same time not to be easily broken and detached out from the grip portion 49.

The more the thumb bends in the palm, the more the drawing force of the flexors of the thumb can be generated and the thumb can firmly grasp the grip portion 49, which means the thumb should be more inclined to the index finger and/or middle finger with respect to the longitudinal axis X of the grip portion 49. Thus, the finger supporter T is angled to be inclined anticlockwise with respect to the axis X of the grip portion 49 to support the flexed thumb, as shown in FIGS. 3 and 6.

The dotted arrow U in FIG. 6 is the extension line of the straight line between the fore end part 57 and rear end part 59 of the finger supporter T.

Namely, the dotted arrow U denotes the direction of the finger supporter T with respect to the axis X of the grip portion 49.

In FIG. 6, the finger supporter T is inclined anticlockwise to have the angle A with respect to the axis X of the grip portion 49 with the side 81 on which the finger supporter T being on the plane. Thus, in the expression reading "the angle of the finger supporter T with respect to the axis X of the grip portion", the term "angle" denotes the anticlockwise angle A between the longitudinal axis X of the grip portion 49 and the extension line of the straight line between the fore and rear end part of the finger supporter T. The angle A may be ranged between 15 degrees and 135 degrees. However, this does not limit the range of the angle A. Further, in any case, the angle A should not be 180 degrees with respect to the axis X of the grip portion 49.

It is preferable that the finger supporter T is shaped to be vertical or substantially vertical to the surface of the grip portion 49 in order to provide equal disposition and arrangement for the thumb and the index finger.

Further, in some cases, the finger supporter T may optionally be formed to have a little inclination with respect to the surface of the grip portion 49.

The dotted arrow V in FIGS. 7 and 8 is the extension line of the straight line between the outer end part 55 and inner end part 53 of the finger supporter T. Namely, the dotted arrow V denotes the direction of the finger supporter T with respect to the surface of the grip portion 49.

Thus, in the expression reading "the angle of the finger supporter T with respect to the surface of the grip portion", the term "angle" denotes the angle B between the surface of the grip portion 49 and the extension line of the straight line between the outer and inner end part of the finger supporter T, as shown in FIG. 7. The angle B may be ranged between 60 degrees and 165 degrees. However, this does not limit the range of the angle B.

The upper side 51 of the finger supporter T may be even and straight or arcuately curved along its longitudinal length.

In FIG. 6, the shape of the finger supporter T along its length is that of an arcuately bent plate to naturally receive the thumb when the thumb bends in accordance with its inherent direction of locomotion. In FIG. 4, the drawing force of the flexors of the thumb(vector "a") and that of the adductors of the four fingers(vector "e") are exerted, from opposing direction, to the same finger supporter T. Thus, it is preferable that the finger supporter T and the surface of the grip portion 49 is arranged to provide equal or similar shape, structure and disposition for the thumb and index (and/or middle) finger to exert the drawing force to the optimal.

In FIG. 7, slightly concave grooves 56 and 54 is formed on the upper side 51 and bottom side 52 of the finger supporter T to receive the round surface of the periphery of the thumb and index finger, respectively. The grooves 56 and 54 are continuously formed along the longitudinal length of the finger supporter T. The grooves 56 and 54 are so shaped as to provide a smoothly curved transition between the surface of the upper side 51 and bottom side 52 of the finger supporter T and the surface 81 of the grip portion 49. Thus, the finger supporter T is arcuately curved and has slightly concave grooves formed in the upper and bottom side thereof in such a complementary manner that the thumb and index (or middle) finger can naturally contact with and firmly grasp the finger supporter T.

In some implement such as a golf club, the middle finger rests on the rear side 52 of the finger supporter T and the extreme end of the index finger touches the fore end part 57 of the finger supporter T. Thus, the fore end part 57 of the finger supporter T may be formed to be blunt and curved inwardly to stably receive the round extreme end of the index finger.

Generally, the most sensible part of a finger is the tip part thereof. When the thumb, index(and/or middle) finger and the finger supporter T tightly touch one another and thereby these three elements act as a unified body, the user can grasp and use the gripping part H of an implement with far more enhanced firmness and sensibility.

Accordingly, as shown in FIG. 6, the thickness at the fore end part 57 and/or the rear end part 59 of the finger supporter T may optionally be thinned off(tapered) just like an edge of a wedge, which enables the thumb 71, the index finger 73 (or middle finger 75) and the finger supporter T to tightly contact with one another and thereby helps them to corporate as a single unified member or segment.

The finger supporter T heretofore explained is of almost tetragonal shape, in plane, as shown in FIG. 5, but it may be triangular, semicircular, elliptic, rectangular, or irregular. The rear end part 59 of the finger supporter R may optionally extend downwardly and form a ridge-typed part on the surface of the grip portion 49.

The extending part may have tapering side to receive the ball of the thumb and raised portion to fill the gap between the tip part of the index finger and middle finger such that said extending part is contoured to fitly positioned between the ball of the thumb and the tip parts of the index finger and middle finger when a hand wraps around the gripping part H.

As described, for left hand, the gripping part H having grip portion 49 and finger supporter T formed thereon can be made as a mirror-image version of that for the right hand.

Further, for the handles of the kinds that can alternately be grasped by the right hand or left hand, the finger supporter T can be formed to be symmetrical along the line that runs on the middle of the finger supporter T.

Figure 10:
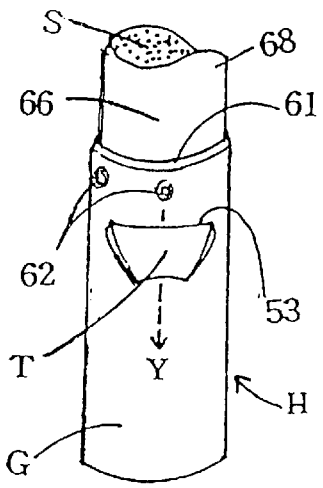

As an example, in FIG. 10, the dotted line Y denotes the axis of the finger supporter T, that is, the dotted line Y denotes the line that runs on the middle of the finger supporter T. The finger supporter T is formed to be symmetrical along the dotted line Y such that it can be grasped by the right hand or left hand alternately.

When the symmetrical finger supporter T such as shown in FIG. 10 is formed on the grip portion 49 such as shown in FIG. 3, the gripping part H can be grasped by the right hand or left hand alternately by merely rotating the gripping part H about 180 degrees.

A further embodiment of the finger supporting structure F of the present invention is comprised of an elongated bar-shaped grip portion having interior hole and adequate length and thickness for a hand to grasp, and a finger supporting means integrally formed thereto.

In FIG. 11, a finger supporting structure F comprised of a grip portion 49 and a finger supporter T integrally formed on the grip portion 49 as a unified body is embodied in the gripping member G.

The grip portion in this embodiment is all or some part of a gripping member G which is separately formed, elongated bar-shaped member having adequate length and thickness for a hand to grasp and an elongated tubular interior hole disposed coaxial to the longitudinal axis of said member and adopted to receive the grasping member of an implement. Said gripping member G is comprised of outer ends 61 and 63, medial grip portion 49 between the outer ends 61 and 63, a finger supporter T formed on the medial grip portion in one piece, and a tubular interior hole 80, as shown in FIG. 11.

The gripping member G is secured to above said bar-shaped shaft S of an implement, and thereby the gripping member G and the shaft S together form the gripping part H of said implement as shown in FIGS. 9 and 10.

The finger supporter T is formed on the gripping member G in one piece at the place on which the thumb touches the index(or middle) finger in order that the finger supporter T may be placed between the thumb and index(or middle) finger when the user's hand grasps the gripping member G.

The gripping member G is adequately secured along the longitudinal length and periphery of the shaft S in order that the finger supporter T on the gripping member G may be placed between the thumb and index finger when the user grasps the gripping part H to use the implement in a normal fashion.

The characteristic features and embodiments heretofore described in connection with the grip portion 49 and finger supporter T shown in FIG. 3 can also be embodied in the gripping member G in FIG. 11.

The grasping member(shaft S), gripping part H, gripping member G, finger supporter T and other elements or members can be made of various types of known materials having hard, durable, rigid characteristics such as wood, metal, rubber, synthetic materials, petrochemical derivatives or composites, or mixtures thereof.

The grasping member(shaft S), gripping part H, gripping member G and finger supporter T are altogether fabricated in a piece by known methods such as molding, welding, pressing, and the like.

Further, the gripping part H, gripping member G and/or finger supporter T are separately manufactured and assembled to form one piece.

When the grasping member has rectangular configuration in cross section, the internal hole of the gripping member G is also formed to have rectangular configuration to conform to the contour of the grasping member.

When the grasping member has rectangular configuration in cross section, the finger supporter T formed on the grip portion or gripping member G may be provided to be positioned on the surface of more than one sides.

The gripping member G may adhesively fit over the shaft of the implements or known locking means such as screws or bolts may be provided on the gripping member G to prevent the gripping member G from rotating and/or axially moving about on the shafts. For examples, in FIGS. 19C and 22, the gripping member G is fastened to the shaft S by a locking screw 60 and locking rings 64 having locking bolts 69, respectively.

Further, the gripping member G may be so secured to the shaft of an implement that it may rotate and/or axially move about on the shaft of the implement. In FIG. 10, as a known retaining structure, retainer holes 62 receiving release button incorporated therein are provided to the gripping member G for the gripping member G to rotate around the shaft S.

Figure 12:
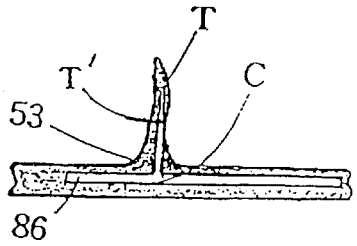
FIG. 12 is a cross sectional view taken along the line N—N in FIG. 11.
Figure 13:
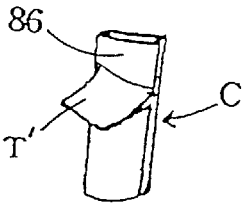
FIG. 13 is a perspective view of a core member C.

As the finger supporter T is of a thin plate shape, it may not be rigidly support the digits or may easily be broken off from the grip portion 49. As shown in FIGS. 12 and 13, a core member C comprised of a protrusion T' and support member 86 may be separately made and embedded in the grip portion 49 of the grasping member or gripping member G where the finger supporter T is to be formed.

The protrusion T' is formed on the support member 86 as an integral unit thereof. Both the protrusion T' and the support member 86 can be made of rigid material such as metal, synthetic material or the like.

The dotted line C in FIG. 11 illustrates an example of the embedded core member in FIG. 13. FIG. 12 is a cross sectional view taken along the line N—N in FIG. 11. In FIG. 12, a "⊥" shaped sectional view of the core member C embedded in the gripping member G is illustrated.

The examples of implements having the finger supporting structure F of the present invention embodied therein are illustrated in FIGS. 9 through 38.

A further embodiment of the present invention relates to the handle of a skipping rope having above said finger supporting structure F.

A skipping rope is generally comprised of an elongated handle member 120, a rope 121 that is rotatably connected to the forward end of the handle member 120 by means of swivel structure 122, as shown in FIG. 14.

With conventional skipping rope handle the grip portion of which has a merely even surface, the user can not sufficiently perform the exercise.

In order to overcome the deficiencies of conventional handle members of skipping rope handles, above said finger supporting structure F is provided to the handle member of a skipping rope handle.

In this embodiment, the handle member 120 itself becomes the grip portion 120 for a hand to grasp. Above said finger supporter T is provided to the grip portion of the handle member 120, near to the fore end where the swivel structure 122 is provided and thereby the grip portion 120 having the finger supporter T forms the gripping part H having finger supporter T of the handle member of a skipping rope.

A further embodiment of the present invention relates to a handle of an exercising apparatus having above said finger supporting structure F.

Said exercising apparatus is generally comprised of two handle members 125 and 129 one ends of which are connected together by a coil spring 127, and a rope for skipping (not shown) being rotatably connected to the other end of any one handle member 125 (opposite to the end where the coil spring is connected) by means of known swivel structure 122, as shown in FIG. 15.

In exercising, one can use the handle members 125 as a handle of skipping rope and one can, in turn, exercise his grip using the two handle members 125 and 129 connected together by the coil spring 127.

In this embodiment, the handle member 125 itself becomes the grip portion 125 for a hand to grasp. Above said finger supporter T is provided to the grip portion 125 of the handle member, near to the fore end where the swivel structure 122 is provided and thereby the grip portion having the finger supporter T forms the gripping part H having finger supporter T of the handle member of an exercising apparatus.

A further embodiment of the present invention relates to bar-shaped handle grips for a rocking type ride-on toy having above said finger supporting structure F. A rocking type ride-on toy or "rocking horse", generally comprises a support platform 132, a ride-on member 131 such as an animal replica mounted on the frame of said support platform 132, and a par of bar-shaped handle grips S secured to the opposite sides of the head part 133 of said ride-on member 131, and grip portion 135 provided to each of the handle grips S as shown in FIG. 16. Said support platform 132 may have a stationary frame or rocking frame well known in the art. In FIG. 16, a stationary frame is drawn in dotted lines and connected to the ride-on member 131 having a saddle 136 by means of springs 134.

In case of conventional rocking horse, as the handle grip(s) is a mere cylindrical bar and it is, in most cases, grasped by the children who are not skillful in grasping something, the children can not firmly grasp nor sufficiently control the whole rocking horse. In order to overcome the deficiencies of conventional handle grips of rocking horses, above said finger supporting structure F is provided to the handle grip of a rocking horse.

In the first embodiment, above said finger supporter T is provided to the grip portion 135 of the handle grip S in one piece as shown in FIG. 16, and thereby the grip portion 135 having the finger supporter T forms the gripping part H having finger supporter T of the handle grip S for a rocking horse.

In a further embodiment, above said gripping member G is secured to the grip portion 135 of the handle grip S, and thereby the medial grip portion of the gripping member G and the grip portion of the handle grip S secured to the gripping member G together form the gripping part H having finger supporter T of the handle grip S for a rocking horse.

A further embodiment of the present invention relates to the loom of an oar having above said finger supporting structure F.

A basic oar will normally comprise a straight, elongated loom that has a medial hand grip area and two opposite outer ends, and one or two blades provided at one or both outer ends of said loom.

The oars may be, on the whole, classified under three types of oars.

The first type is an oar which comprises an elongated loom S that has a medial hand grip area 141 and two opposite outer ends, a blade 143 provided at one outer end of said loom S, and a vertical grip 142 at the other outer end of said loom S, as shown in FIG. 17.

In some oars, the loom has a blade provided at one end thereof and the other end of the loom is a mere extension of the medial hand grip area which mostly has the same bar shape as the medial hand grip area and there is provided one or two grip portions near the other end of the loom.

In case of double bladed paddle for canoe, kayak and the like, the loom has two blades each of which is provided at each outer end of the loom and two grip portions are provided on the medial hand grip area, near to each blade, respectively. With the conventional oar the grip portion of which has merely even and uniform surface, the user can not firmly grasp the grip portion of the loom nor sufficiently control the whole oar. In order to overcome the deficiencies of conventional looms of oars, above said finger supporting structure F is provided to the loom of an oar.

In the first embodiment, above said finger supporter T is provided to said grip portion 145 of the loom in one piece, and thereby the grip portion 145 having the finger supporter T forms the gripping part H having finger supporter T of the loom of an oar. In a further embodiment, above said gripping member G is secured to said grip portion 145 of the loom of an oar as shown in FIG. 17, and thereby the medial grip portion of the gripping member G and the grip portion 145 of the medial hand grip area 141 secured to the gripping member G together form the gripping part H having finger supporter T of the loom of an oar.

For the loom having two grip portions, two gripping parts H for both hands may be symmetrical to each other.

A further embodiment of the present invention relates to the handle shaft of a mountain climbing equipment having above said finger supporting structure F. As an example of the mountaineering equipments, FIG. 18 illustrates an ice axe which generally comprises an elongated, cylindrical handle shaft 147 having fore end and rear end, head part 146 made of metal, affixed at fore end of said handle shaft, and a grip portion 149 provided at the rear end of said handle shaft 147.

With a conventional mounting climbing equipment having a mere bar-shaped grip portion, the user can not firmly grasp the grip portion thereof nor sufficiently control the whole mountain climbing equipment.

In order to overcome the deficiencies of conventional handle shafts of mountain climbing equipments, above said finger supporting structure F is provided to the handle shaft of a mountain climbing equipment.

In the first embodiment, above said finger supporter T is provided to the grip portion 149 of the handle shaft in one piece, and thereby the grip portion 149 having the finger supporter T forms the gripping part H having finger supporter T of the handle shaft of a mountain climbing equipment.

In a further embodiment, above said gripping member G is secured to said grip portion 149 as shown in FIG. 18, and thereby the medial grip portion of the gripping member G and the grip portion 149 of the handle shaft 147 secured to the gripping member G together form the gripping part H having finger supporter T of the handle shaft of a mountain climbing equipment.

The description is mostly directed to an ice axe in FIG. 18. However, it is to be understood that gripping part H having the finger supporter T provided to the ice axe is also adapted for use with any type of mountaineering equipments such as hammer axe, piton hammer and the like which have an elongated handle shaft, head part made of metal affixed at one end of the handle shaft and a grip portion provided at the other end of the handle shaft.

A further embodiment of the present invention relates to the handle member of physical training equipments having above said finger supporting structure F.

Gymnasiums, fitness centers, and exercise or health clubs offer numerous physical training equipments such as rowing exercisers, squatting exercisers, pressing exercisers, stationary bikes or cycling exercisers, treadmills, expanders, pulleys, lat machines, horizontal bars, and the like.

These physical training equipments have handle members in the form of elongated bars, handles, or handgrips and the handle member has grip portion for the user's hand. Said handle member is an elongated bar-shaped member having a grip portion at the mid portion thereof.

With the physical training equipments the grip portion of which has conventional cylindrical bar shape and merely even and uniform surface, the user can not grasp the grip portion thereof with full power, firmness and stability nor maximize the efficiency of the exercise.

In order to overcome the deficiencies of conventional handle members of physical training equipments, above said finger supporting structure F is provided to the handle member of a physical training equipment.

In the first embodiment, above said finger supporter T is provided to said grip portion in one piece, and thereby the grip portion having the finger supporter T forms the gripping part H having finger supporter T of the handle member of a physical training equipment.

In a further embodiment, above said gripping member G is secured to the grip portion of the handle member, and thereby the medial grip portion of the gripping member G and the grip portion of the handle member secured to the gripping member G together form the gripping part H having finger supporter T of the handle member of a physical training equipment.

A further embodiment of the present invention relates to the bar of a barbell having above said finger supporting structure F. FIG. 19 illustrates three parts of barbells, in which, for convenience, only one end or middle part of the shaft S of several embodiments of the bar and the weights associated therewith are shown. The barbell is of course symmetrical.

A basic barbell will normally comprise, as shown in FIG. 19A, a straight, elongated bar 151 that has a medial hand grip area and opposite outer ends, and weights of circular disk(such as 152 in FIG. 19A and 154 in FIG. 19C, for example) mounted adjacent said outer ends, and grip portions provided on said medial hand grip area. Said medial hand grip area of the bar 151 has a straight bar shape throughout its length, and has a pair of grip portions 156 provided on the medial hand grip area, adjacent to each weights, on which average man normally places the hands.

Some modified types of barbells employ bars with arcuate portions such as so called "E-Z curl bar" as shown in FIG. 19B. These types of barbells generally comprises an elongated bar having a medial hand grip area provided with an arcuate mid portion and opposite outer ends, and weights (such as 152 in FIG. 19A and 154 in FIG. 19C, for example) mounted on said outer ends.

Said medial hand grip area of the bar is comprised of an arcuate mid portion 153 and two straight portions(similar to those 151 in FIG. 19A and 155 in FIG. 19C, for example).

Said arcuate mid portion 153 has two angular segments 157 at its outer ends and the two straight portions extend from said angular segments 157, respectively. The two angular segments 157 extend in mutually opposite directions and are disposed to be at acute angles to the longitudinal axis 150 of the straight portion of the bar for the hands to be turned at different positions inwardly or outwardly. Grip portions are provided to the angular segments 157 and the two straight portions.

There are other modifications that have been made to the basic barbell including the use of rotatable handles mounted on the bar that can be moved against a spring resistance or slidable handles that can longitudinally move along the central portion of the bar.

As the bar of conventional barbells is cylindrical metallic bar having relatively small diameter while it carries relatively heavy weights, the user can not firmly grasp the bar nor sufficiently control the whole barbell. In order to overcome the deficiencies of conventional bars of barbells, above said finger supporting structure F is provided to the bar of a barbell.

In the first embodiment, above said finger supporter T is provided to each grip portion in one piece as shown in FIGS. 19A and 19B, and thereby the grip portion having finger supporter T(T1, T2) forms the gripping part H(H1, H2) having finger supporter T. The finger supporters T may be formed on the straight portions of the bar having straight portions and arcuate mid portion.

In a further embodiment, above said gripping member G is secured to the grip portion 158 of the bar 155, and thereby the medial grip portion of the gripping member G and the grip portion 158 of the bar 155 secured to the gripping member G together form the gripping part H having finger supporter T of the bar of a barbell as shown in FIG. 19C. The gripping member G may also be provided to above said angular segment of the arcuate mid portion of the bar which has straight portions and arcuate mid portion.

A further embodiment of the present invention relates to the grip bar of a dumbbell or an aerobic handweight having above said finger supporting structure F. A basic barbell will normally comprise an elongated cylindrical grip bar 164 having adequate length to be gripped in a hand, normally metallic, with weights 163 of circular plate or disk positioned at opposite free ends of the grip bar 164 as shown in FIG. 20.

Some modified types of dumbbells or aerobic handweights employ bars provided with known retaining means such as straps or members of rigid material that are attached to the grip bar and fit across the back of the hand and facilitate the exerciser holding the handweight while the exerciser moves his arm in a prescribed fashion. In FIG. 20, the retaining means 165 drawn in dotted lines is comprised of a strap and is connected to the grip bar 161. There are other types of dumbbells that employ all these grip bars, weights and retaining means(such as 161, 163 and 165 in FIG. 20, for example).

For convenience, the term "dumbbell" is used to representatively denote the dumbbells and aerobic handweights throughout the specification.

Said grip bar 164 has opposite free ends attached to said weights 163 and a grip portion 161 at the mid portion of the grip bar 164. The length of the grip portion 161 is almost the same as that of the grip bar 164.

As the grip bar of conventional dumbbells is cylindrical metallic bar having small diameter while it carries relatively heavy weight, the user can not firmly and comfortably grasp the grip bar nor sufficiently control the whole dumbbell. In order to overcome the deficiencies of conventional grip bars of dumbbells, above said finger supporting structure F is provided to the grip bar of a dumbbell.

In the first embodiment, above said finger supporter T is provided to the grip portion 161 of the grip bar 164 in one piece as shown in FIG. 20, and thereby the grip portion 161 having the finger supporter T forms the gripping part H having finger supporter T of the grip bar of a dumbbell.

In a further embodiment, above said gripping member G is secured to said grip portion 161 of the grip bar 164, and thereby the medial grip portion of the gripping member G and the grip portion 161 of the grip bar 164 secured to the gripping member G together form the gripping part H having finger supporter T of the grip bar of a dumbbell. It is preferable that the length of the gripping member G is almost the same as that of the grip portion 161. The gripping member G secured to the grip portion may be fixed thereto or may rotate around the grip portion.

A further embodiment of the present invention relates to the handle section of a fishing rod having above said finger supporting structure F.

Generally, most of fishing rod assemblies are comprised of an elongated tubular handle section and a plurality of rod sections that can be connectable in telescoping relation to one another and retractable for storage in said elongated tubular handle section. These fishing rod assemblies may be, on the whole, classified under two types of fishing rods.

The first type generally has an elongated tubular handle section 171 which has a mere even and uniform surface without any protuberances such as reel seat, and the grip portion at the butt end thereof as shown in FIG. 21.

The second type of fishing rod generally has an elongated tubular handle section 171 that has a reel seat 172 for receiving a reel and two grip portions, i.e., the lower grip portion 174 and/or upper grip portion 175 as shown in FIG. 22. In short, the handle section 171 has fore end that is connectable to the segment parts and butt end, and grip portion(s) 173, 174 or 175 provided near to the fore end and/or at the butt end thereof.

In casting the lure to a desired location for fishing, what is important is the control ability over the rod.

With the fishing rod the grip portion of which has even and uniform surface, i.e., the handle section of the fishing rod has no reel seat, the angler can not sufficiently control the whole fishing rod.

In fighting a big fish, the angler mostly grasps the upper grip portion 175 with one hand and the handle of the reel with the other hand. Accordingly, with the fishing rod the upper grip portion 175 of which has even and uniform surface, the angler may not firmly grasp the grip portion nor sufficiently control the whole fishing rod.

In order to overcome the deficiencies of conventional handle sections of fishing rods, above said finger supporting structure F is provided to the handle section of a fishing rod.

In the first embodiment, above said finger supporter T is provided to the grip portion of the handle section 171 in one piece, and thereby the grip portion having the finger supporter T forming the gripping part H having finger supporter T of the handle section of a fishing rod.

In a further embodiment, above said gripping member G is secured to said grip portion of the handle section 171, and thereby the medial grip portion of the gripping member G and the grip portion of the handle section 171 secured to the gripping member G together form the gripping part H having finger supporter T of the handle section of a fishing rod.

A further embodiment of the present invention relates to the handle section of a fish landing net having above said finger supporting structure F.

A fish landing net assembly is generally comprised of an elongated tubular handle section 177 having fore end connectable to a segment part 178 and butt end, a plurality of segment parts 178 connectable in telescoping relation to one another and retractable for storage in said handle section, net part 179 connected to the distal end of said segment parts, and grip portion 170 provided at the butt end of the handle section 177 as shown in FIG. 23.

With conventional fish landing net the handle section of which has a merely even and uniform surface, the angler can not sufficiently control the whole fish landing net. In order to overcome the deficiencies of conventional handle sections of fish landing nets, above said finger supporting structure F is provided to the handle section of a fish landing net.

In the first embodiment, above said finger supporter T is provided to the grip portion 170 of the handle section 177 in one piece, and thereby the grip portion 170 having the finger supporter T forms the gripping part H having finger supporter T of the handle section 177 of a fish landing net.

In a further embodiment, above said gripping member G is secured to said grip portion 170 of the handle section 177 as shown in FIG. 23, and thereby the medial grip portion of the gripping member G and the grip portion 170 secured to the gripping member G together form the gripping part H having finger supporter T of the handle section 177 of a fish landing net.

A further embodiment of the present invention relates to the handle member of a racquet having above said finger supporting structure F.

There have been several types of racquets such as tennis racquets, badminton racquets, racquetball racquets, squash racquets, and the like, each of which comprises a head with stringed surface, a shaft connected with the head, and a bar-shaped handle member integrally extending from the shaft.

For convenience, the term "racquet" is used to representatively designate above said racquets which comprises a head, a shaft connected with the head, and a handle member extending from the shaft.

Figure 24:
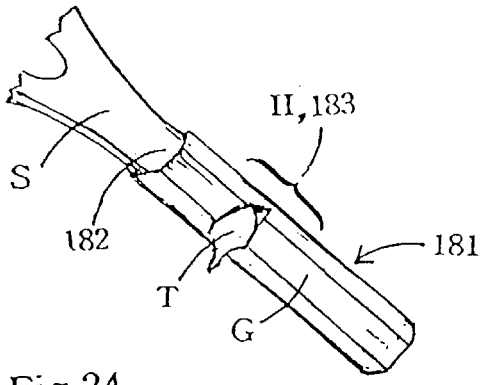
FIG. 24 illustrates in part, a handle of a tennis racquet

As an example, FIG. 24 illustrates, in part, a tennis racquet 181 which generally comprises a head with stringed surface, a shaft S connected with the head, an elongated handle member 182 extending from said shaft S and having grip portion 183 provided at the mid portion of said handle member 182.

With a racquet the handle member of which has a merely even and uniform surface, the user can not firmly grasp the handle member of the racquet nor sufficiently control the whole racquet. In order to overcome the deficiencies of conventional racquets, above said finger supporting structure F is provided to the handle member of a racquet.

In the first embodiment, above said finger supporter T is provided to said grip portion 183 in one piece, and thereby the grip portion 183 having the finger supporter T forms the gripping part H having finger supporter T of the handle member of a racquet.

In a further embodiment, above said gripping member G is secured to said grip portion 183 as shown in FIG. 24, and thereby the medial grip portion of the gripping member G and the grip portion 183 of the handle member 182 secured to the gripping member G together form the gripping part H having finger supporter T of the handle member of a racquet.

A further embodiment of the present invention relates to the handle of a ski pole having above said finger supporting structure F.

As shown in FIG. 9, a ski pole generally comprises an elongated ski pole shaft S having upper end part 187(see dotted line) and lower end part, a ring(not shown) provided at the lower end part of said shaft S, and a handle member mounted to the upper end part 187 of the ski pole shaft S. Said upper end part 187 and the handle member mounted thereto together form the handle 185 of a ski pole. With a conventional ski pole, one can not firmly grasp the handle with full power nor sufficiently control the whole ski pole.

In order to overcome the deficiencies of conventional ski poles, above said finger supporting structure F is provided to the handle of a ski pole.

Above said gripping member G, as a handle member, is secured to the grasping member in the form of the upper end part 187 of the pole shaft S, as shown in FIG. 9, and thereby the medial grip portion of the gripping member G and the upper end part 187 of the pole shaft S secured to the gripping member G together form the gripping part H having finger supporter T of the handle of a ski pole.

A further embodiment of the present invention relates to bar-shaped handles for vehicular means or carriage implements having above said finger supporting structure F.

There are several types of vehicular means or carriage implements having bar-shaped handles. Of these, a bicycle, tricycle and the like are foot-driven vehicular means and a motorcycle, motor scooter, endless track vehicle such as snow mobile, personal watercraft type vehicle such as "Z-ski" and the like are motor driven vehicular means. A handcart having two or three wheels may be said hand-driven carriage implement. For convenience, the term "vehicular means" is used to representatively designate all these hand-driven, foot-driven, motor driven vehicular means or carriage implements having bar-shaped handles throughout the specification.

These vehicular means have a pair of bar-shaped cylindrical handle members mounted on the opposite outer end parts of an elongated handle bar shaft(s) S symmetrically provided to the body of said vehicular means.

Said outer end part of the handle bar shaft and the bar-shaped handle member secured to said outer end part of the handle bar shaft together form a handle of the vehicular means for a user to grasp.

Figure 25:
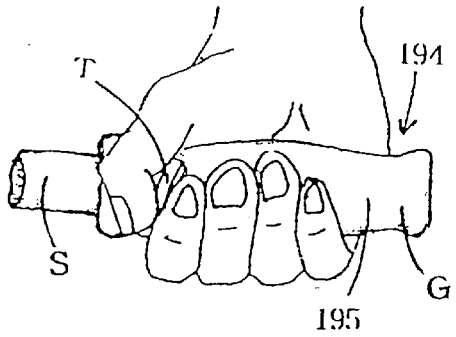
FIGS. 25 and 26 illustrate, in part, the handles of bicycles.

FIG. 25 illustrates bottom side of the handle of a bicycle such as a mountain bike, in part, and a hand grasping it, in which a gripping member G, as a handle member, is secured to the grasping member in the form of the outer end part 195 of the cross handle bar shaft S. Thus, the gripping member G and the outer end part 195 together form the handle 194 of said bicycle.

The handles for conventional bicycles, motorcycles, scooters, snow mobiles, Z-ski, carts, and tricycles are similar to that shown in FIG. 25.

Figure 26:
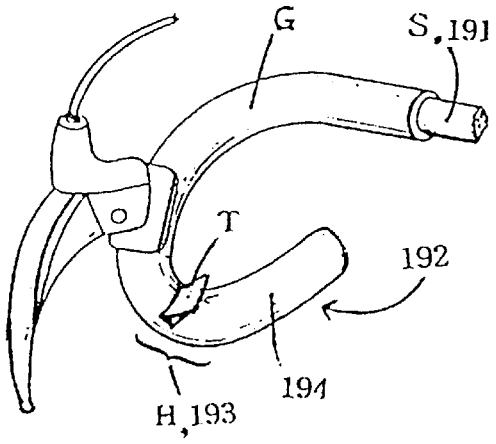

FIG. 26 is a partly broken view of a conventional drop handle of a bicycle in which a cross handle bar 191 carries a U-shaped outer end part 194 at the outer end thereof, and an elongated gripping member G is secured to the shaft S of said outer end part 194. Thus, the gripping member G and the U-shaped outer end part 194 together form a drop handle 192 of a bicycle.

When running at high speed or uneven road, as the user must more firmly grasp the handles of vehicular means, and what is worse, sometimes with the index and middle fingers extending to grasp the brake levers, the grasping power of the digits, especially the thumb, is quite unstable and weak. In order to overcome the deficiencies of conventional handles of the vehicular means, above said finger supporting structure F is provided to the handle member of a vehicular means.

Said gripping member G is secured to said outer end part 195(or 194) and thereby the medial grip portion of the gripping member G and the outer end part 195(or 194) of the handle bar shaft S secured to the gripping member G together form the gripping part H having finger supporter T of the bar-shaped handles for vehicular means or carriage implements.

The description is mostly directed to the handles of bicycles drawn in FIGS. 25 and 26. However, it is to be understood that gripping member G is also adapted for use with any type of bar-shaped handles of hand-driven, foot-driven, or motor-driven vehicular means or carriage implements such as a bicycle, tricycle, motorcycle, motor scooter, endless track vehicle such as a snowmobile, watercraft type vehicle such as "Z-ski", a hand cart, and the like.

A further embodiment of the present invention relates to the grip of a golf club having above said finger supporting structure F.

Figure 27:
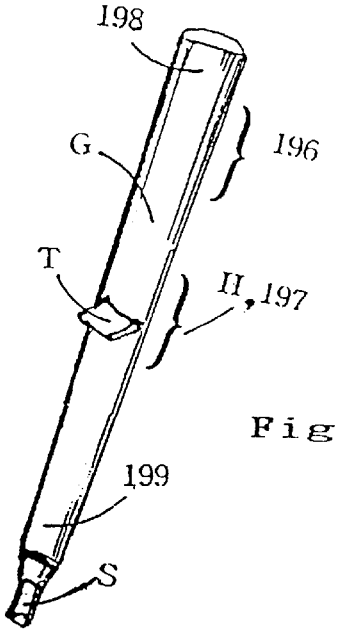
FIG. 27 illustrates, in part, the grip of golf club.

A golf club generally comprises a head, an elongated shaft S and a grip member as shown in FIG. 27. Said shaft S has upper portion and lower end.

Said grip member is fixedly secured to the upper portion of said shaft S and the head is affixed at the lower end of said shaft S(not shown).

With conventional golf clubs, the golfer can not stably control both the hand and club while swinging. In order to overcome the deficiencies of conventional grips of golf clubs, above said finger supporting structure F is provided to the grip of a golf club. Above said gripping member G is formed to have upper cap end 198 and lower end 199, upper grip portion 196 for the upper hand and lower grip portion 197 for the lower hand, a finger supporter T fixedly provided to the lower grip portion 197, and an internal hole to receive the golf club shaft. Said gripping member G, as a grip member, is secured to the grasping member in the form of the shaft S, and thereby the lower grip portion 197 of the gripping member G and the upper portion of the shaft S secured to the gripping member G together form the gripping part H having finger supporter T of the grip of a golf club.

A further embodiment of the present invention relates to the stick shaft of a game stick having above said finger supporting structure F.

In the present invention, the term "game stick" refers to the implements such as hockey sticks or the like; such sticks includes, for example, ice hockey sticks, street hockey sticks, ringuette sticks, exercise wands, lacrosse stick shafts, curling broom shafts, and the like.

Figure 28:
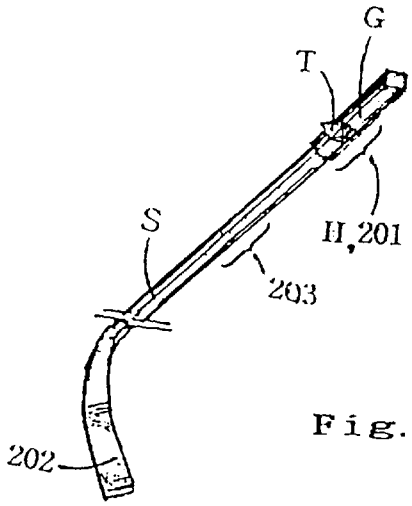
FIG. 28 illustrates, in part, a hockey stick.

A game stick generally comprises an elongated stick shaft S having upper and lower ends, an upper grip portion 201 and mid grip portion 203 provided at the upper end and mid portion of the shaft S, respectively, and a blade 202 affixed to the lower end of the shaft S similar to the hockey stick in FIG. 28.

As the upper grip portion of the conventional stick shaft is a mere extension of the bar-shaped shaft, the player can not precisely aware the orientation of the blade nor sufficiently control the whole game stick. In order to overcome the deficiencies of conventional shafts of game sticks, above said finger supporting structure F is provided to the shaft of a game stick.

In the first embodiment, above said finger supporter T is provided to said upper grip portion 201 in one piece, and thereby the upper grip portion 201 having the finger supporter T forms the gripping part H having finger supporter T of the stick shaft of a game stick.

In a further embodiment, above said gripping member G is secured to said upper grip portion 201 and thereby the medial grip portion of the gripping member G and the upper grip portion 201 of the stick shaft S secured to the gripping member G together form the gripping part H of the stick shaft of a game stick.

The description is mostly directed to the ice hockey stick. However, the gripping part H having the finger supporter T is also adapted for use with any type of bar-shaped elongated game stick which has upper grip portion and mid grip portion, such as street hockey sticks, ringuette sticks, exercise wands, lacrosse stick shafts, curling broom shafts, and the like.

A further embodiment of the present invention relates to the hand grip area of a baseball bat having above said finger supporting structure F.

A baseball bat generally comprises a barrel that has large diameter and is used to strike the ball, a hand grip area which integrally extends from the barrel and has smaller diameter than the barrel, and a knob located at the end of the hand grip area as shown in FIG. 29. Said hand grip area 205 has upper grip portion 207 and lower grip portion 209 that is located below the upper grip portion 207 and adjacent to the knob 208.

With a conventional bat having a mere bar-shaped hand grip area, the user can not firmly grasp the hand grip area of the bat nor sufficiently control the whole bat. In order to overcome the deficiencies of conventional hand grip areas of baseball bats above said finger supporting structure F is provided to the hand grip area of a baseball bat.

In the first embodiment, above said finger supporter T is provided to said upper grip portion 207 in one piece, and thereby the upper grip portion 207 having the finger supporter T forms the gripping part H having finger supporter T of the hand grip area of a baseball bat.

In a further embodiment, above said gripping member G is secured to said upper grip portion 207 as shown in FIG. 29, and thereby the medial grip portion of the gripping member G and the upper grip portion 207 of a baseball bat secured to the gripping member G together form the gripping part H having the finger supporter T of the hand grip area of a baseball bat.

A further embodiment of the present invention relates to the cue shaft of a billiard cue having above said finger supporting structure F.

A billiard cue generally comprises an elongated cylindrical cue shaft S having fore end and butt end 214, tip portion 212 mounted on the extremity of the fore end of the cue shaft S as shown in FIG. 30. Said cue shaft S has a grip portion 211 near the butt end 214. With a conventional billiard cue having a mere bar-shaped cue shaft, the user can not stably grasp the cue shaft of the cue nor sufficiently control the whole cue.

In order to overcome the deficiencies of conventional cue shafts of billiard cues, above said finger supporting structure F is provided to the cue shaft of a billiard cue.

In the first embodiment, above said finger supporter T is provided to said grip portion 211 in one piece, and thereby the grip portion 211 having the finger supporter T forms the gripping part H having finger supporter T of the cue shaft of a billiard cue.

In a further embodiment, above said gripping member G is secured to said grip portion 211 as shown in FIG. 30, and thereby the medial grip portion of the gripping member G and the grip portion 211 of the cue shaft S secured to the gripping member G together form the gripping part H having the finger supporter T of the cue shaft of a billiard cue.

A further embodiment of the present invention relates to the handle of umbrella, parasol and the like having above said finger supporting structure F.

For convenience, the term "umbrella" is used to representatively designate these umbrellas, parasols and the like.

An umbrella generally comprises an elongated central shaft S having upper end part and lower end part 215, umbrella ribs and cloths connected to the upper end part of the central shaft S, and a bar-shaped short handle member or crooked handle member mounted to the lower end part 215 of the central shaft S, as shown in FIG. 31 which illustrates a foldaway umbrella.

With a conventional umbrella, especially when it is windy, one can not firmly grasp the handle nor sufficiently control the whole umbrella. In order to overcome the deficiencies of conventional umbrellas, above said finger supporting structure F is provided to the handle member of an umbrella.

Above said gripping member G is of short bar shape or crooked bar shape and is secured to the lower end part 215 of central shaft S, and thereby the grip portion of the gripping member G and the lower end part 215 of central shaft S secured to the gripping member G together form the gripping part H having finger supporter T of the handle of an umbrella.

In FIG. 31, the general shape of the gripping member G is a short rectangular bar. When a crooked gripping member G is provided to an umbrella, the grip portion having the finger supporter T is provided to the part of the gripping member G which receives the lower end of the central shaft S and which the user normally grasps to hold the umbrella.

A further embodiment of the present invention relates to handle parts of truncheons, nightsticks or police batons having above said finger supporting structure F. The term "police baton" is used to representatively designate all these truncheons, nightsticks or police batons and the like. A police baton generally comprises an elongated cylindrical club part S having upper end 222 and lower end 220 and a coaxial handle part 225 which integrally and coaxially extends from the lower end 220 of the club part S as shown in FIG. 32.

In some modified police baton known as a side handle baton, a laterally extending transverse handle part 224 is further provided at the lower end 220 of the club part S, in the proximity of the coaxial handle part 225. In FIG. 32, a transverse handle part 224 is drawn in dotted lines.

The coaxial handle part 225 and transverse handle part 224 have grip portion 221 and 223, at the mid portions thereof, respectively.

With a conventional police baton having a mere bar-shaped handle part, the user can not firmly grasp the handle part of the baton nor sufficiently control the whole baton.

In order to overcome the deficiencies of conventional handle parts of police batons above said finger supporting structure F is provided to the handle part of a police baton.

In the first embodiment, above said finger supporter T is provided to said grip portion 221 of coaxial handle part 225 and/or grip portion 223 of transverse handle part 224 in one piece, and thereby the grip portion having the finger supporter T forms the gripping part H having finger supporter T of the handle part of a police baton.

In a further embodiment, above said gripping member G is secured to the grip portion 221 of coaxial handle part 225 as shown in FIG. 32(and/or the grip portion 223 of transverse handle part 224), and thereby the medial grip portion of the gripping member G and the grip portion 221 of coaxial handle part 225(and/or the grip portion 223 of transverse handle part 224) secured to the gripping member G together form the gripping part H having finger supporter T of the handle part of a police baton.

A further embodiment of the present invention relates to handgrips for walking aid implements having above said finger supporting structure F.

For the aged or patients, there have been various types of walking aid implements such as sticks, canes, crutches, walkers and the like. The term "walking aid implement" is used to representatively designate all these sticks, canes, bifurcated crutches, walkers and the like having handgrip(s).

On the whole, the walking aid implements can be classified under three types. The first type, such as a stick or cane, is shown in FIG. 33 in which a crooked handgrip 227 having fore end 226, rear end 228 and grip portion 229 is provided at the upper end of the ground engaging strut-shaft S. At the fore end 226 the handgrip 227 curves downwardly and extends to the upper end of the ground engaging strut-shaft S. Said handgrip provided at the upper end of the shaft may be crooked or "T" shaped or pistol grip handle, and in case of the ground engaging strut-shaft having arm-rest, a short bar-shaped handgrip is provided near the upper end of the ground engaging strut-shaft. The second type is a bifurcated crutch that normally comprises a bifurcated main frame, an elongated ground engaging strut-shaft connected to the bifurcated main frame, and a handgrip provided at the middle of the bifurcated main frame. The third type is a walker which comprises right, left and fore side frames which are connected to each other, a plurality of ground engaging strut-shaft extending from the frames, and handgrips provided at the horizontal top bar of each side frame.

In short, each of the handgrips of these three types of walking aid implements generally comprises a cylindrical bar having a grip portion provided at the mid portion thereof. With the walking aid implements the handgrip(s) of which has conventional cylindrical bar shape and merely even and uniform surface, the user can not grasp the handgrip(s) thereof with firmness and stability. In order to overcome the deficiencies of conventional handgrips of walking aid implements, above said finger supporting structure F is provided to the handgrip of a walking aid implement.

In the first embodiment, above said finger supporter T is provided to said grip portion of the handgrip in one piece, and thereby said grip portion having the finger supporter T forms the gripping part H having finger supporter T of the handgrip for a walking aid implement.

In a further embodiment, above said gripping member G is secured to the grip portion of the handgrip as shown in FIG. 33, and thereby the medial grip portion of the gripping member G and the grip portion of the handgrip secured to the gripping member G together form the gripping part H having finger supporter T of the handgrip for a walking aid implement.

A further embodiment of the present invention relates to handle shafts for cleaning implements having above said finger supporting structure F.

Cleaning implements or dusting things adapted for manual use are mops and brooms that have elongated handle shafts held by the hands. The term "cleaning implement" is used to designate these dusting things.

A cleaning implement such as a mop or broom generally consists of an elongated handle shaft S having upper and lower ends, a cleaning member 242, i.e. dustcloth or broom part, connected to said lower end of the handle shaft S, and an upper grip portion 241 and mid grip portion 243 provided at the upper end and mid portion of the handle shaft S, respectively. With conventional cleaning implement, the user can not firmly grasp nor sufficiently control the whole cleaning implement. In order to overcome the deficiencies of conventional cleaning implements, above said finger supporting structure F is provided to the handle shaft of a cleaning implement.

In the first embodiment, above said finger supporter T is provided to said upper grip portion 241 and/or the mid grip portion 243 in one piece, and thereby the upper grip portion 241 and/or the mid grip portion 243 having the finger supporter T forms the gripping part H having finger supporter T of the handle shaft S for a cleaning implement. In a further embodiment, above said gripping member G is secured to the grip portion of the handle shaft S as shown in FIG. 34, and thereby the medial grip portion of the gripping member G and the grip portion of the handle shaft S secured to the gripping member G together form the gripping part H having finger supporter T of the handle shaft S for a cleaning implement.

A further embodiment of the present invention relates to handle shafts of folding shovels having above said finger supporting structure F.

A folding shovel is a kind of camping or military equipment and is generally comprised of an elongated, cylindrical handle shaft S having fore end and rear end, a foldable blade 246 made of metal, connected at the fore end of the handle shaft S, and a grip portion 245 provided at the rear end of said handle shaft S as shown in FIG. 35. With a conventional folding shovel having a mere bar-shaped grip portion, the user can not firmly grasp nor sufficiently control the whole folding shovel. In order to overcome the deficiencies of conventional handle shafts of folding shovels, above said finger supporting structure F is provided to the handle shaft of a folding shovel.

In the first embodiment, above said finger supporter T is provided to the grip portion 245 of the handle shaft S in one piece, and thereby the grip portion 245 having the finger supporter T forms the gripping part H having finger supporter T of the handle shaft S for a folding shovel.

In a further embodiment, above said gripping member G is secured to said grip portion 245 as shown in FIG. 35, and thereby the medial grip portion of the gripping member G and the grip portion 245 of the handle shaft S secured to the gripping member G together form the gripping part H having finger supporter T of the handle shaft S for a folding shovel.

A further embodiment of the present invention relates to handle shafts for farming or gardening implements having the finger supporting structure F.

Farming or gardening implements such as shovels, spades, forks, hoes, rakes, sickles, hooks, scythes, weeders, tillers and the like are adapted for manual use in lifting, carrying, digging, pushing or dragging loads, soil, snow, hay, or the like. The term "farming implement" is used to designate above said farming or gardening implements having an elongated handle shaft.

These farming implements generally comprise elongated handle shafts S having upper and lower ends, implement head part 252 provided at lower end of the handle shafts S such as blades, tines, prongs, and the like normally made of metal, and upper grip portion 251 and mid grip portion 253 provided at the upper end and the mid portion of the handle shaft S, respectively.

The upper grip portion 251 of the handle shaft S may be the extension of the mid portion of handle shaft S having a bar shape, or handle shaft S may have bifurcated arms at the upper end thereof and a vertical hand grip having grip portion 251 provided between the bifurcated arms as a shovel in FIG. 36.

With conventional farming implement the user can not firmly grasp nor sufficiently control the whole farming implement.

In order to overcome the deficiencies of conventional farming implements, above said finger supporting structure F is provided to the handle shaft of a farming implement.

In the first embodiment, above said finger supporter T is provided to said upper grip portion 251 and/or the mid grip portion 253 in one piece, and thereby the upper grip portion 251 and/or the mid grip portion 253 having the finger supporter T forms the gripping part H(H1 and/or H2) having finger supporter T of the handle shaft S for a farming implement.

In a further embodiment, above said gripping member G is secured to the upper grip portion 251 and/or mid grip portion 253 as shown in FIG. 36, and thereby the medial grip portion of the gripping member G and the upper grip portion 251 and/or mid grip portion 253 of the handle shaft S secured to the gripping member G together form the gripping part H(H1 and/or H2) having finger supporter T of the handle shaft S for a farming implement.

A further embodiment of the present invention relates to the handle shaft for impacting implements or implements for impact application having above said finger supporting structure F.

Impacting implements or implements for impact application such as hammer, mallet, maul, ax, hatchet, pickaxe, mattock, kitchen knife, cleaver and the like are adapted for manual use in hammering, chopping, striking, hitting or impacting objects and the like. The term "impacting implement" is used to designate these impacting implements or implements for impact application.

As shown in FIG. 37 which illustrates a hammer, the impacting implement generally comprises an elongated handle shaft S having forward end and rear end, implement head part 262 such as heads, blades, and the like normally made of metal, wood, rubber, or plastics, provided at the forward end of said shaft S, and grip portion 261 provided at the rear end of said shaft S.

With a conventional impacting implement having a mere bar-shaped grip portion, the user can not accurately apply impact to the object nor sufficiently control the whole impacting implement. In order to overcome the deficiencies of conventional impacting implements, above said finger supporting structure F is provided to the handle shaft of an impacting implement.

In the first embodiment, above said finger supporter T is provided to said grip portion 261 in one piece, and thereby the grip portion 261 having the finger supporter T forms the gripping part H having finger supporter T.

In a further embodiment, above said gripping member G is secured to the grip portion of the handle shaft S as shown in FIG. 37, and thereby the medial grip portion of the gripping member G and the grip portion of the handle shaft S secured to the gripping member G together form the gripping part H having finger supporter T of the handle shaft S for an impacting implement.

A further embodiment of the present invention relates to the handles for sawing implements having above said finger supporting structure F. Sawing implements such as handsaw, ripsaw, hacksaw, lumberman's two handed saw, and the like are adapted for manual use in sawing and cutting. For convenience, the term "sawing implement" is used to representatively designate these various types of saws.

A sawing implement generally comprises an elongated saw blade and a handle shaft positioned at one side(or both sides) of said saw blade. Said handle shaft is slant or almost vertical with respect to the longitudinal axis of the saw blade and has grip portion at the mid portion thereof.

As an example of sawing implements, FIG. 38 illustrates a hacksaw which comprises an adjustable frame 273, a saw blade 272 secured to the adjustable frame 273 and a handle shaft S(dotted line) downwardly, extended at one end of said frame 273, and above said gripping member G secured to said handle shaft S as above said handle member 271 of ordinary sawing implement.

With a conventional sawing implement having a mere bar-shaped grip portion, the user can not accurately control the whole sawing implement. In order to overcome the deficiencies of conventional sawing implements, above said finger supporting structure F is provided to the handle of the sawing implement.

Above said gripping member G is secured to the grip portion of the handle shaft S and thereby the medial grip portion of the gripping member G and the handle shaft S secured to the gripping member G together form the gripping part H having finger supporter T of the handle of sawing implement.

While there is shown and described the present preferred embodiments of the invention, it is to be distinctly understood that the invention is not limited thereto but may be variously embodied to practice within the scope of the following claims.

What is claimed are:

1. A finger supporting structure (F) comprising a grip portion (49) and a finger supporter (T) formed thereto;

said grip portion (49) being of an elongated bar shape and having adequate length and thickness for user's four fingers to wrap in one direction and the thumb in the opposite direction, said grip portion (49) being all or some part of a grasping member of an implement, and said grasping member being an elongated bar-shaped physical member of an implement for a user's hand to grasp to use the implement, said grip portion(49) having fore side (83), rear side (85), outer side (87) and inner side (81), said inner side (81) having thumb touching part (82) on which the thumb touches and finger touching part (84) on which the four fingers excluding the thumb touch, and the surfaces of the thumb touching part (82) and the surface of the part of the finger touching part (84) on which the index finger is placed being formed to have substantially the same surface level along the length of said grip portion (49), said finger supporter (T) being a laterally extending projection which is fixedly and rigidly formed on said inner side (81) of the grip portion (49) in one piece, said finger supporter (T) being so formed to be positioned at the place of the grip portion (49) on which the thumb touches the index finger that the finger supporter (T) may be placed between the thumb and index finger when a hand grasps the grip portion (49), said finger supporter (T) having upper side (51) and bottom side (52) to receive the thumb and the index finger, respectively, and having fore end part (57), rear end part (59), inner end part (53) and outer end part (55), and said inner end part (53) being integrally connected to said inner side (81) of the grip portion (49), said finger supporter (T) having adequate length and width, said length denoting the distance between the fore end part (57) and rear end part (59) and said width denoting the distance between the inner end part (53) and outer end part (55), said fore end part (57) and rear end part (59) of the finger supporter (T) being touched by the distal phalanx part of the thumb and the inner part of the thumb, respectively, said finger supporter (T) having moderate thickness to be placed between the thumb and index finger, the straight line between the fore end part (57) and rear end part (59) of the finger supporter (T) being angled to be inclined anticlockwise with respect to the longitudinal axis (X) of the grip portion (49), the straight line between the outer end part (55) and the inner end part (53) of the finger supporter (T) being substantially vertical to the surface of the grip portion (49), and said upper side (51) of the finger supporter (T) and the thumb touching part (82) of the inner side (81) to receive the thumb and said bottom side (52) of the finger supporter (T) and the finger touching part (84) of the inner side (81) to receive the index finger being so formed to have substantially equal or similar structure and disposition that the drawing force of the thumb and that of the four fingers may be concentrated to and encounter with each other at the finger supporter (T).

2. A finger supporting structure (F) comprising a grip portion (49) and a finger supporter (T) formed thereto;

said grip portion (49) being of an elongated bar shape and having adequate length and thickness for user's four fingers to wrap in one direction and the thumb in the opposition direction, said grip portion (49) being all or some part of a gripping member (G) which is separately formed for being secured to all or some part of a grasping member of an implement, said grasping member being an elongated bar-shaped physical member of an implement for a user's hand to grasp to use the implement, said gripping member (G) being of an elongated bar shape and having adequate length and thickness for a hand to grasp and a tubular interior hole (80) to receive all or some part of the grasping member of an implement, said gripping member (G) having outer ends (61) and (63), and medial grip portion (49) between said outer ends (61) and (63), said grip portion (49) having fore side (83), rear side (85), outer side (87) and inner side (81), said inner side (81) having thumb touching part (82) on which the thumb touches and finger touching part (84) on which the four fingers excluding the thumb touch, and the surfaces of the thumb touching part (82) and the surface of the part of the finger touching part (84) on which the index finger is placed being formed to have substantially the same surface level along the length of said grip portion (49), said finger supporter (T) being a laterally extending projection which is fixedly and rigidly formed on said inner side (81) of the grip portion (49) in one piece, said finger supporter (T) being so formed to be positioned at the place of the grip portion (49) on which the thumb touches the index finger that the finger supporter (T) may be placed between the thumb and index finger when a hand grasps the grip portion (49), said finger supporter (T) having upper side (51) and bottom side (52) to receive the thumb and the index finger, respectively, and having fore end part (57), rear end part (59), inner end part (53) and outer end part (55), and said inner end part (53) being integrally connected to said inner side (81) of the grip portion (49), said finger supporter (T) having adequate length and width, said length denoting the distance between the fore end part (57) and rear end part (59) and said width denoting the distance between the inner end part (53) and outer end part (55), said fore end part (57) and rear end part (59) of the finger supporter (T) being touched by the distal phalanx part of the thumb and the inner part of the thumb, respectively, said finger supporter (T) having moderate thickness to be placed between the thumb and index finger, the straight line between the fore end part (57) and rear end part (59) of the finger supporter (T) being angled to be inclined anticlockwise with respect to the longitudinal axis (X) of the grip portion (49), the straight line between the outer end part (55) and inner end part (53) of the finger supporter (T) being substantially vertical to the surface of the grip portion (49), and said upper side (51) of the finger supporter (T) and the thumb touching part (82) of the inner side (81) to receive the thumb and said bottom side (52) of the finger supporter (T) and the finger touching part (84) of the inner side (81) to receive the index finger being so formed to have substantially equal or similar structure and disposition that the drawing force of the thumb and that of the four fingers may be concentrated to and encounter with each other at the finger supporter (T).

3. The finger supporting structure (F) according to claim 1, wherein said finger supporting structure (F) is provided to the handle member of a skipping rope;

said skipping rope generally comprising an elongated handle member and a rope which is rotatably connected to the forward end of the handle member by means of swivel structure, said handle member providing a grip portion for a hand to grasp, and above said finger supporter (T) being provided to said grip portion in one piece, near to the fore end where the swivel structure is provided, and thereby the grip portion having the finger supporter (T) forming the gripping part (H) having a finger supporting structure (F) of the handle member of a skipping rope.

4. The finger supporting structure (F) according to claim 1, wherein said finger supporting structure (F) is provided to the handle member of an exercising apparatus;

said exercising apparatus being generally comprised of two handle members, one end of each handle member being connected together by a coil spring, and a rope for skipping being rotatably connected to the other rend of nay one handle member opposite to the end where the coil spring is connected by means of known swivel structure, said one handle member providing a grip portion for a hand to grasp, and above said finger supporter (T) being provided to said grip portion in one piece, near to the fore end where the swivel structure is provided, and thereby the grip portion having the finger supporter (T) forming the gripping part (H) having a finger supporting structure (F) of the handle member of an exercising apparatus.

5. The finger supporting structure (F) according to claim 1, wherein said finger supporting structure (F) is provided to the handle grips of a rocking type ride-on toy;

said rocking type ride-on toy generally comprising a support platform, a ride-on member mounted on the frame of said support platform, a pair of bar-shaped handle grips (S) secured to the opposite sides of the head part of said ride-on member, each of the handle grips (S) providing a grip portion for a hand to grasp, and above said finger supporter (T) being provided to said grip portion in one piece, and thereby the grip portion having the finger supporter (T) forming the gripping part (H) having a finger supporting structure (F) of the handle grip for a rocking type ride-on toy.

6. The finger supporting structure (F) according to claim 2, wherein said finger supporting structure (F) is provided to the handle grips of a rocking type ride-on toy;

said rocking type ride-on toy generally comprising a support platform, a ride-on member mounted on the frame of said support platform, a pair of bar-shaped handle grips (S) secured to the opposite sides of the head part of said ride-on member, each of the handle grips (S) providing a grip portion for a hand to grasp, and above said gripping member(s) (G) being secured to said grip portion, and thereby the medial grip portion of the gripping member (G) having the finger supporter (T) and the grip portion of the handle grip (S) secured to the gripping member (G) forming the gripping part (H) having a finger supporting structure (F) of the handle grip for a rocking type ride-on toy.

7. The finger supporting structure (F) according to claim 1, wherein said finger supporting structure (F) is provided to the loom of an oar;

said oar comprising a straight, elongated loom having a medial hand grip area and opposite ends, one or two blades connected to the loom, one of said opposite ends of the loom being provided with a blade, and the other end of said opposite ends of the loom being provided with a vertical grip or a blade, or being an extension of the medial hand grip area, said medial hand grip area being provided with one or two grip portions for a hand to grasp, said grip portion(s) being positioned near the blade(s) and/or at the extension of the medial hand grip area, and above said finger supporter (T) being provided to said grip portion in one piece, and thereby the grip portion having the finger supporter (T) forming the gripping part (H) having a finger supporting structure (F) of the loom of an oar.

8. The finger supporting structure (F) according to claim 2, wherein said finger supporting structure (F) is provided to the loom of an oar;

said oar comprising a straight, elongated loom having a medial hand grip area and opposite ends, one or two blades connected to the loom, one of said opposite ends of the loom being provided with a blade, and the other end of said opposite ends of the loom being provided with a vertical grip or a blade, or being an extension of the medial hand grip area, said medial hand grip area being provided with one or two grip portions for a hand to grasp, said grip portion(s) being positioned near the blade(s) and/or at the extension of the medial hand grip area, and above said gripping member (G) being secured to said grip portion, and thereby the medial grip portion of the gripping member (G) having the finger supporter (T) and the grip portion of the medial hand grip area secured to the gripping member (G) forming the gripping part (H) having a finger supporting structure (F) of the loom of an oar.

9. The finger supporting structure (F) according to claim 1, wherein said finger supporting structure (F) is provided to the handle shaft of a mounting climbing equipment;

said mountain climbing equipment generally comprising an elongated, cylindrical handle shaft having fore end and rear end, head part affixed at the fore end of said handle shaft, said rear end of the handle shaft providing a grip portion for a hand to grasp, and above said finger supporter (T) being provided to said grip portion in one piece, and thereby the grip portion having the finger supporter (T) forming the gripping part (H) having a finger supporting structure (F) of the handle shaft of a mountain climbing equipment.

10. The finger supporting structure (F) according to claim 2, wherein said finger supporting structure (F) is provided to the handle shaft of a mounting climbing equipment;

said mountain climbing equipment generally comprising an elongated, cylindrical handle shaft having fore end and rear end, head part affixed at the fore end of said handle shaft, said rear end of the handle shaft providing a grip portion for a hand to grasp, and above said gripping member (G) being secured to said grip portion, and thereby the medial grip portion of the gripping member (G) having the finger supporter (T) and the grip portion of the handle shaft secured to the gripping member (G) forming the gripping part (H) having a finger supporting structure (F) of the handle shaft of a mountain climbing equipment.

11. The finger supporting structure (F) according to claim 1, wherein said finger supporting structure (F) is provided to the bars, handles, or hand grips of physical training equipments;

said physical training equipment being any one of rowing exercisers, squatting exercisers, pressing exercisers, cycling exercisers, treadmills, expanders, pulleys, lat machines, horizontal bars, and the like which are offered at gymnasiums, fitness centers, exercise clubs, health clubs and the like, said bar, handle or hand grip of a physical training equipment generally comprising a handle member that is of an elongated cylindrical bar shape, mid portion of said handle member providing a grip portion for a hand to grasp, and above said finger supporter (T) being provided to said grip portion in one piece, and thereby the grip portion having the finger supporter (T) forming the gripping part (H) having a finger supporting structure (F) of the handle member of a physical training equipment.

12. The finger supporting structure (F) according to claim 2, wherein said finger supporting structure (F) is provided to the bars, handles, or hand grips of physical training equipments;

said physical training equipment being any one of rowing exercisers, squatting exercisers, pressing exercisers, cycling exercisers, treadmills, expanders, pulleys, lat machines, horizontal bars, and the like which are offered at gymnasiums, fitness centers, exercise clubs, health clubs and the like, said bar, handle or hand grip of a physical training equipment generally comprising a handle member that is of an elongated cylindrical bar shape, mid portion of said handle member providing a grip portion for a hand to grasp, and above said gripping member (G) being secured to said grip portion, and thereby the medial grip portion of the gripping member (G) having the finger supporter (T) and the grip portion of the handle member secured to the gripping member (G) forming the gripping part (H) having a finger supporting structure (F) of the handle member of a physical training equipment.

13. The finger supporting structure (F) according to claim 1, wherein said finger supporting structure (F) is provided to the bar of a barbell;

said barbell comprising an elongated bar having a medial hand grip area and opposite outer ends, weights of circular disk mounted on said outer ends, said medial hand grip area having a straight bar shape throughout its length or having straight portions and arcuate mid portion, said arcuate mid portion having two angular segments extending in mutually opposite directions and being disposed to be at an acute angles to the longitudinal axis of the straight portion of the bar, one or two pairs of grip portions for a hand to grasp being provided, adjacent to the weight, to said straight portion and/or said angular segments of the arcuate mid portion of the bar, and above said finger supporter (T) being provided to said grip portions in one piece, and thereby the grip portion having the finger supporter (T) forming the gripping part (H) having a finger supporting structure (F) of the bar of a barbell.

14. The finger supporting structure (F) according to claim 2, wherein said finger supporting structure (F) is provided to the bar of a barbell;

said barbell comprising an elongated bar having a medial hand grip area and opposite outer ends, weights of circular disk mounted on said outer ends, said medial hand grip area having a straight bar shape throughout its length or having straight portions and arcuate mid portion, said arcuate mid portion having two angular segments extending in mutually opposite directions and being disposed to be at an acute angles to the longitudinal axis of the straight portion of the bar, one or two pairs of grip portions for a hand to grasp being provided, adjacent to the weight, to said straight portion and/or said angular segments of the arcuate mid portion of the bar, and above said gripping member (G) being secured to said grip portions, and thereby the medial grip portion of the gripping member (G) having the finger supporter (T) and the grip portion of the bar secured to the gripping member (G) forming the gripping part (H) having a finger supporting structure (F) of the bar of a barbell.

15. The finger supporting structure (F) according to claim 1, wherein said finger supporting structure (F) is provided to the grip bar of dumbbells or hand weights;

said dumbbell comprising an elongated grip bar having adequate length to be gripped in a hand and opposite free ends, weights and/or retaining means connected to the grip bar, said weights being circular plate or disk that are attached to said opposite free ends of the bar, said retaining means being straps or members of rigid material that are connected to said opposite free ends of the bar, said grip bar providing a grip portion at the mid portion thereof for a hand to grasp, and above said finger supporter (T) being provided to said grip portion in one piece, and thereby the grip portion having the finger supporter (T) forming the gripping part (H) having a finger supporting structure (F) of the grip bar of a dumbbell.

16. The finger supporting structure (F) according to claim 2, wherein said finger supporting structure (F) is provided to the grip bar of dumbbells or hand weights;

said dumbbell comprising an elongated grip bar having adequate length to be gripped in a hand and opposite free ends, weights and/or retaining means connected to the grip bar, said weights being circular plate or disk that are attached to said opposite free ends of the bar, said retaining means being straps or members of rigid material that are connected to said opposite free ends of the bar, said grip bar providing a grip portion at the mid portion thereof for a hand to grasp, and above said gripping member (G) being secured to said grip portion, and thereby the medial grip portion of the gripping member (G) having the finger supporter (T) and the grip portion of the grip bar secured to the gripping member (G) forming the gripping part (H) having a finger supporting structure (F) of the grip bar of a dumbbell.

17. The finger supporting structure (F) according to claim 1, wherein said finger supporting structure (F) is provided to the handle section of a fishing rod;

said fishing rod generally comprising an elongated tubular handle section having a plurality of segment parts which can be connectable in telescoping relation to one another and retractable for storage in said handle section, said handle section having fore end which is connectable to the segment parts and butt end, a grip portion(s) being provided near to the fore end and/or at the butt end of said handle section for a hand to grasp, and above said finger supporter (T) being provided to said grip portion in one piece, and thereby the grip portion having the finger supporter (T) forming the gripping part (H) having a finger supporting structure (F) of the handle section of a fishing rod.

18. The finger supporting structure (F) according to claim 2, wherein said finger supporting structure (F) is provided to the handle section of a fishing rod;

said fishing rod generally comprising an elongated tubular handle section having a plurality of segment parts which can be connectable in telescoping relation to one another and retractable for storage in said handle section, said handle section having fore end which is connectable to the segment parts and butt end, a grip portion(s) being provided near to the fore end and/or at the butt end of said handle section for a hand to grasp, and above said gripping member (G) being secured to said grip portion, and thereby the medial grip portion of the gripping member (G) having the finger supporter (T) and the grip portion of the handle section secured to the gripping member (G) forming the gripping part (H) having a finger supporting structure (F) of the handle section of a fishing rod.

19. The finger supporting structure (F) according to claim 1, wherein said finger supporting structure (F) is provided to the handle section of a fish landing net;

said fish landing net generally comprising an elongated tubular handle section having fore end connectable to a segment part and butt end, a plurality of segment parts connectable in telescoping relation to one another and retractable for storage in said handle section, net part connected to the distal end of said segment parts, a grip portion for a hand to grasp being provided at the butt end of the handle section, and above said finger supporter (T) being provided to said grip portion in one piece, and thereby the grip portion having the finger supporter (T) forming the gripping part (H) having a finger supporting structure (F) of the handle section of a fish landing net.

20. The finger supporting structure (F) according to claim 2, wherein said finger supporting structure (F) is provided to the handle section of a fish landing net;

said fish landing net generally comprising an elongated tubular handle section having fore end connectable to a segment part and butt end, a plurality of segment parts connectable in telescoping relation to one another and retractable for storage in said handle section, net part connected to the distal end of said segment parts, a grip portion for a hand to grasp being provided at the butt end of the handle section, and above said gripping member (G) being secured to said grip portion of the handle section, and thereby the medial grip portion of the gripping member (G) having the finger supporter (T) and the grip portion of the handle section secured to the gripping member (G) forming the gripping part (H) having a finger supporting structure (F) of the handle section of a fish landing net.

21. The finger supporting structure (F) according to claim 1, wherein said finger supporting structure (F) is provided to the handle member of a racquet;

said racquet generally comprising a head with stringed surface, a shaft connected with the head, an elongated handle member extending from said shaft, a grip portion for a hand to grasp being provided at the mid portion of said handle member, and above said finger supporter (T) being provided to said grip portion in one piece, and thereby the grip portion having the finger supporter (T) forming the gripping part (H) having a finger supporting structure (F) of the handle member of a racquet.

22. The finger supporting structure (F) according to claim 2, wherein said finger supporting structure (F) is provided to the handle member of a racquet;

said racquet generally comprising a head with stringed surface, a shaft connected with the head, an elongated handle member extending from said shaft, a grip portion for a hand to grasp being provided at the mid portion of said handle member, and above said gripping member (G) being secured to said grip portion of the handle member, and thereby the medial grip portion of the gripping member (G) having the finger supporter (T) and the grip portion of the handle member secured to the gripping member (G) forming the gripping part (H) having a finger supporting structure (F) of the handle member of a racquet.

23. The finger supporting structure (F) according to claim 2, wherein said finger supporting structure (F) is provided to the handle of a ski pole;

said ski pole generally comprising an elongated ski pole shaft (S) having upper end part and lower end part, a ring provided at the lower end part of said shaft (S) and a handle member secured to said upper end part of the shaft, and above said gripping member (G) as a handle member being secured to said upper end part, and thereby the medial grip portion of the gripping member (G) having the finger supporter (T) and the said upper end part of the pole shaft secured to the gripping member (G) forming the gripping part (H) having a finger supporting structure (F) of the handle of a ski pole.

24. The finger supporting structure (F) according to claim 2, wherein said finger supporting structure (F) is provided to a bar-shaped handle of hand-driven, foot-driven, or motor-driven vehicular means;

said handle of vehicular means generally comprising an elongated handle bar shaft (S) and a bar-shaped handle member secured to the outer end of said handle bar shaft (S), said handle bar shaft (S) having an elongated bar portion connected to the body of vehicular means and outer end part provided at the outer end of said bar portion, and above said gripping member (G) as a handle member being secured to said outer end part, and thereby the medial grip portion of the gripping member (G) having a finger supporter (T) and the outer end part of the handle bar shaft secured to the gripping member (G) forming the gripping part (H) having a finger supporting structure (F) of a handle for vehicular means.

25. The finger supporting structure (F) according to claim 2, wherein said finger supporting structure (F) is provided to the grip of a golf club;

said golf club generally comprising an elongated golf club shaft having upper portion and lower end, a head connected to the lower end of the shaft, and a grip member secured to the upper portion of the shaft, above said gripping member (G) being formed to have upper cap end and lower end, upper grip portion for the upper hand and lower grip portion for the lower hand, a finger support (T) fixedly provided to the lower grip portion, and an internal hole and said gripping member (G) being secured to the upper portion of the shaft (S), and thereby the lower grip portion of the gripping member (G) having a finger supporter (T) and the upper portion of the shaft (S) secured to the gripping member (G) forming the gripping part (H) having a finger supporting structure (F) of the grip of a golf club.

26. The finger supporting structure (F) according to claim 1, wherein said finger supporting structure (F) is provided to the stick shaft of a game stick;

said game stick generally comprising an elongated stick shaft (S) having upper and lower ends and a blade affixed to the lower end of the stick shaft (S), an upper grip portion and a mid grip portion for hands to grasp being provided at the upper end and mid portion of the stick shaft (S), respectively, and above said finger supporter (T) being provided to said upper grip portion in one piece, and thereby the upper grip portion having the finger supporter (T) forming the gripping part (H) having a finger supporting structure (F) of the stick shaft of a game stick.

27. The finger supporting structure (F) according to claim 2, wherein said finger supporting structure (F) is provided to the stick shaft of a game stick;

said game stick generally comprising an elongated stick shaft (S) having upper and lower ends and a blade affixed to the lower end of the stick shaft (S), an upper grip portion and a mid grip portion for hands to grasp being provided at the upper end and mid portion of the stick shaft (S), respectively, and above said gripping member (G) being secured to said upper grip portion, and thereby the medial grip portion of the gripping member (G) having the finger supporter (T) and the upper grip portion of the stick shaft secured to the gripping member (G) forming the gripping part (H) having a finger supporting structure (F) of the stick shaft of a game stick.

28. The finger supporting structure (F) according to claim 1, wherein said finger supporting structure (F) is provided to the hand grip area of a baseball bat;

said baseball bat generally comprising a barrel that is used to strike a ball, a hand grip area extending from said barrel, a knob located at the end of the hand grip area, said hand grip area providing upper grip portion and lower grip portion for hands to grasp, said lower grip portion being located below the upper grip portion and adjacent to the knob, and above said finger supporter (T) being provided to said upper grip portion in one piece, and thereby the upper grip portion having the finger support (T) forming the gripping part (H) having a finger supporting structure (F) of the hand grip area of a baseball bat.

29. The finger supporting structure (F) according to claim 2, wherein said finger supporting structure (F) is provided to the hand grip area of a baseball bat;

said baseball bat generally comprising a barrel that is used to strike a ball, a hand grip area extending from said barrel, a knob located at the end of the hand grip area, said hand grip area providing upper grip portion and lower grip portion for hands to grasp, said lower grip portion being located below the upper grip portion and adjacent to the knob, and above said gripping member (G) being secured to said upper grip portion, and thereby the medial grip portion of the gripping member (G) having the finger supporter (T) and the upper grip portion of a baseball bat secured to the gripping member (G) forming the gripping part (H) having a finger supporting structure (F) of the hand grip area of a baseball bat.

30. The finger supporting structure (F) according to claim 1, wherein said finger supporting structure (F) is provided to the cue shaft of a billiard cue; said billiard cue generally comprising an elongated cylindrical cue shaft (S) having butt end and tip portion, a grip portion for a hand to grasp being provided near to said butt end, and above said finger supporter (T) being provided to said grip portion in one piece, and thereby the grip portion having the finger supporter (T) forming the gripping part (H) having a finger supporting structure (F) of the cue shaft of a billiard cue.

31. The finger supporting structure (F) according to claim 2, wherein said finger supporting structure (F) is provided to the cue shaft of a billiard cue;

said billiard cue generally comprising an elongated cylindrical cue shaft (S) having butt end and tip portion, a grip portion for a hand to grasp being provided near to said butt end, and above said gripping member (G) being secured to said grip portion, and thereby the grip portion of gripping member (G) having the finger supporter (T) and the grip portion of the cue shaft secured to the gripping member (G) forming the gripping part (H) having a finger supporting structure (F) of the cue shaft of a billiard cue.

32. The finger supporting structure (F) according to claim 2, wherein said finger supporting means (F) is provided to the handle of an umbrella, parasol and the like;

said umbrella, parasol and the like generally comprising an elongated central shaft (S) having upper end part and lower end part, ribs and cloths connected to the upper end part of the central shaft (S) and a handle member secured to the lower end part of the central shaft (S), above said gripping member (G) as a handle member being secured to said lower end part of the central shaft (S), and thereby the grip portion of the gripping member (G) having the finger supporter (T) and the lower end part of the central shaft (S) secured to the gripping member (G) forming the gripping part (H) having a finger supporting structure (F) of the handle of an umbrella, parasol and the like.

33. The finger supporting structure (F) according to claim 1, wherein said finger supporting means (F) is provided to the handle part of a police baton;

said police baton generally comprising an elongated cylindrical club part (S) having upper end and lower end, a coaxial handle part which integrally and coaxially extends from said club part and located at the lower end of said club part and/or a laterally extending transverse handle part provided at the lower end of said club part (S), said coaxial handle part and/or transverse handle part providing a grip portion at the mid portions thereof, respectively, for a hand to grasp, and above said finger supporter (T) being provided to said grip portion of coaxial handle part and/or said grip portion of transverse handle part in one piece, and thereby the grip portion having the finger supporter (T) forming the gripping part (H) having a finger supporting structure (F) of the handle part of a police baton.

34. The finger supporting structure (F) according to claim 2, wherein said finger supporting means (F) is provided to the handle part of a police baton;

said police baton generally comprising an elongated cylindrical club part (S) having upper end and lower end, a coaxial handle part which integrally and coaxially extends from said club part and located at the lower end of said club part and/or a laterally extending transverse handle part provided at the lower end of said club part (S), said coaxial handle part and/or transverse handle part providing a grip portion at the mid portions thereof, respectively, for a hand to grasp, and above said finger supporter (G) being secured to the grip portion of coaxial handle part and/or the grip portion of transverse handle part, and thereby the medial grip portion of the gripping member (G) having the finger supporter (T) and the grip portion secured to the gripping member (G) forming the gripping part (H) having a finger supporting structure (F) of the handle part of a police baton.

35. The finger supporting structure (F) according to claim 1, wherein said finger supporting structure (F) is provided to the handgrip of a stick-type, bifurcated crutch-type, or walker-type walking aid implement;

said stick-type walking aid implement generally comprising an elongated ground engaging strut-shaft and a handgrip provided at or near the upper end of said shaft, said bifurcated crutch-type walking aid implement comprising a bifurcated main frame, an elongated ground engaging strut-shaft connected to the bifurcated main frame, and a handgrip provided at the middle of the bifurcated main frame, said walker-type walking aid implement comprising right, left and fore side frames which are connected to each other, a plurality of ground engaging strut-shaft extending from the frames, and handgrips provided at the horizontal top bar of each side frame, said handgrip of said walking aid implements generally comprising a cylindrical bar, a grip portion for a hand to grasp being provided at the mid portion of said bar, and said finger supporter (T) being provided to said grip portion in one piece, and thereby the grip portion having the finger supporter (T) forming the gripping part (H) having a finger supporting structure (F) of the handgrip for a walking aid implement.

36. The finger supporting structure (F) according to claim 2, wherein said finger supporting structure (F) is provided to the handgrip of a stick-type, bifurcated crutch-type, or walker-type walking aid implement;

said stick-type walking aid implement generally comprising an elongated ground engaging strut-shaft and a handgrip provided at or near the upper end of said shaft, said bifurcated crutch-type walking aid implement comprising a bifurcated main frame, an elongated ground engaging strut-shaft connected to the bifurcated main frame, and a handgrip provided at the middle of the bifurcated main frame, said walker-type walking aid implement comprising right, left and fore side frames which are connected to each other, a plurality of ground engaging strut-shaft extending from the frames, and handgrips provided at the horizontal top bar of each side frame, said handgrip of said walking aid implements generally comprising a cylindrical bar, a grip portion for a hand to grasp being provided at the mid portion of said bar, and above said gripping member (G) being secured to said grip portion, and thereby the medial grip portion of the gripping member (G) having the finger supporter (T) and the grip portion of the handgrip secured to the gripping member (G) forming the gripping part (H) having a finger supporting structure (F) of the handgrip for a walking aid implement.

37. The finger supporting structure (F) according to claim 1, wherein said finger supporting structure (F) is provided to handle shaft of a cleaning implement;

said cleaning implement generally comprising an elongated handle shaft (S) having upper and lower ends, a cleaning member connected to said lower end of the handle shaft (S), an upper grip portion and a mid grip portion for hands to grasp being provided at the upper end and mid portion of the handle shaft (S), respectively, and above said finger supporter (T) being provided to said upper grip portion and/or the mid grip portion, and thereby the upper grip portion and/or the mid grip portion having the finger supporter (T) forming the gripping part (H) having a finger supporting structure (F) of the handle shaft for a cleaning implement.

38. The finger supporting structure (F) according to claim 2, wherein said finger supporting structure (F) is provided to the handle shaft of a cleaning implement;

said cleaning implement generally comprising an elongated handle shaft (S) having upper and lower ends, a cleaning member connected to said lower end of the handle shaft (S), an upper grip portion and a mid grip portion for hands to grasp being provided at the upper end and mid portion of the handle shaft (S), respectively, and above said gripping member (G) being secured to said upper grip portion or the mid grip portion of the handle shaft, and thereby the medial grip portion of the gripping member (G) having the finger supporter (T) and the upper grip portion or the mid grip portion of the handle shaft secured to the gripping member (G) forming the gripping part (H) having a finger supporting structure (F) of the handle shaft for a cleaning implement.

39. The finger supporting structure (F) according to claim 1, wherein said finger supporting structure (F) is provided to the handle shaft of a folding shovel;

said folding shovel comprising an elongated, cylindrical handle shaft (S) having fore end and rear end, and a foldable blade connected at the fore end of the handle shaft (S), a grip portion for a hand to grasp being provided at the rear end of said handle shaft (S), and above said finger supporter (T) being provided to said grip portion in one piece, and thereby the grip portion having the finger supporter (T) forming the gripping part (H) having a finger supporting structure (F) of the handle shaft for a folding shovel.

40. The finger supporting structure (F) according to claim 2, wherein said finger supporting structure (F) is provided to the handle shaft of a folding shovel;

said folding shovel comprising an elongated, cylindrical handle shaft (S) having fore end and rear end, and a foldable blade connected at the fore end of the handle shaft (S), a grip portion for a hand to grasp being provided at the rear end of said handle shaft (S), and above said gripping member (G) being secured to said grip portion, and thereby the medial grip portion of the gripping member (G) having the finger supporter (T) and the grip portion of the handle shaft secured to the gripping member (G) forming the gripping part (H) having a finger supporting structure (F) of the handle shaft for a folding shovel.

41. The finger supporting structure (F) according to claim 1, wherein said finger supporting structure (F) is provided to the handle shaft of a farming implement;

said farming implement generally comprising an elongated bar-shaped handle shaft, an implement head part provided to the handle shaft, said handle shaft having upper end, lower end and mid portion, said implement head part being connected to the lower end of the handle shaft, said upper end of the handle shaft being the extension of the bar-shaped mid portion of the handle shaft or being formed to have bifurcated arms, and a vertical hand grip provided between the bifurcated arms, mid grip portion being provided to said mid portion of the handle shaft and upper grip portion being provided at the bar-shaped upper end of the handle shaft or at the vertical hand grip between the bifurcated arms of the upper end of the handle shaft, for hands to grasp, and said finger supporter(s) (T) being provided to said upper grip portion and/or said mid grip portion in one piece, and thereby the upper grip portion and/or the mid grip portion having the finger supporter(s) (T) forming the gripping part(s) (H) having a finger supporting structure (F) of the handle shaft for a farming implement.

42. The finger supporting structure (F) according to claim 2, wherein said finger supporting structure (F) is provided to the handle shaft of a farming implement;

said farming implement generally comprising an elongated bar-shaped handle shaft, an implement head part provided to the handle shaft, said handle shaft having upper end, lower end and mid portion, said implement head part being connected to the lower end of the handle shaft, said upper end of the handle shaft being the extension of the bar-shaped mid portion of the handle shaft or being formed to have bifurcated arms, and a vertical hand grip provided between the bifurcated arms, mid grip portion being provided to said mid portion of the handle shaft and upper grip portion being provided at the bar-shaped upper end of the handle shaft or at the vertical hand grip between the bifurcated arms of the upper end of the handle shaft, for hands to grasp, and said gripping member (G) being secured to said upper grip portion and/or the mid grip portion of the handle shaft, and thereby the medial grip portion of the gripping member (G) having the finger supporter (T) and the upper grip portion and/or the mid grip portion of the handle shaft secured to the gripping member (G) forming the gripping part (H) having a finger supporting structure (F) of the handle shaft for a farming implement.

43. The finger supporting structure (F) according to claim 1, wherein said finger supporting structure (F) is provided to the handle shaft of an impacting implement;

said impacting implement generally comprising an elongated handle shaft (S) having forward end and rear end, implement head part such as heads, blades, and the like normally made of metal, wood, rubber, or plastics, provided at the forward end of said shaft (S), a grip portion for a hand to grasp being provided at the rear end of said shaft (S), and above said finger supporter (T) being provided to said grip portion in one piece, and thereby the grip portion having the finger supporter (T) forming the gripping part (H) having a finger supporting structure (F) of the handle shaft for an impacting implement.

44. The finger supporting structure (F) according to claim 2, wherein said finger supporting structure (F) is provided to the handle shaft of an impacting implement;

said impacting implement generally comprising an elongated handle shaft (S) having forward end and rear end, implement head part such as heads, blades, and the like normally made of metal, wood, rubber, or plastics, provided at the forward end of said shaft (S), a grip portion for a hand to grasp being provided at the rear end of said shaft (S), and above said gripping member (G) being secured to said grip portion, and thereby the medial grip portion of the gripping member (G) having the finger supporter (T)and the grip portion of the handle shaft secured to the gripping member (G) forming the gripping part (H) having a finger supporting structure (F) of the handle shaft for an impacting implement.

45. The finger supporting structure (F) according to claim 2, wherein said finger supporting structure (F) is provided to the handle shaft of a sawing implement;

said sawing implement generally comprising an elongated saw blade and a handle shaft positioned at one side (or both sides) of said saw blade, and a handle member secured to said handle shaft, said handle shaft being slant or almost vertical with respect to the longitudinal axis of the saw blade, and above said gripping member (G) as a handle member being secured to said handle shaft, and thereby the medial grip portion of the gripping member (G) having the finger supporter (T) and the handle shaft secured to the gripping member (G) forming the gripping part (H) having a finger supporting structure (F) of the handle for a sawing implement.

46. The finger supporting structure (F) according to claim 1 or 2, wherein, the length of the finger supporter (T) ranges from 10 mm to 60 mm and the width of the finger supporter (T) ranges from 10 mm to 40 mm.

47. The finger supporting structure (F) according to claim 1 or 2, wherein, the angle between the straight line between the fore end part (57) and rear end part (59) of the finger supporter (T) and the longitudinal axis (X) of the grip portion (49) ranges between 15 degrees and 135 degrees, and the angle between the straight line between the outer end part (55) and inner end part (53) of the finger supporter (T) and the surface of the grip portion (49) ranges between 60 degrees and 165 degrees.

48. The finger supporting structure (F) according to claim 1 or 2, wherein, the finger supporter (T) is a thin plate-shaped projection.

49. The finger supporting structure (F) according to claim 1 or 2, wherein, slightly concave grooves (56 and 54) are formed on the upper side (51) and bottom side (52) of the finger supporter (T), respectively, said grooves (56 and 54) are continuously formed along the longitudinal length of the finger supporter (T), and said grooves (56 and 54) are so shaped as to provide a smoothly curved transition between the surfaces of the upper side (51) and the thumb touching part (82) of the inner side (81) and the surfaces of the bottom side (52) and the finger touching part (84) of the inner side (81), respectively.

50. The finger supporting structure (F) according to claim 1 or 2, wherein, the thickness at the fore end part (57) and/or the rear end part (59) of the finger supporter (T) is thinned off (tapered) just like an edge of a wedge.

51. The finger supporting structure (F) according to claim 1 or 2, wherein, the finger supporter (T) is formed to be symmetrical along the line that runs on the middle of the finger supporter (T).

52. The finger supporting structure (F) according to claim 1 or 2, wherein, a core member (C) made of rigid material such as metal, synthetic material or the like is separately prepared and embedded in the grip portion (49) where the finger supporter (T) is to be formed, and said core member (C) is comprised of a support member (86) and a protrusion (T') which is formed on the support member (86) as an integral unit thereof.

* * * * *